US012630275B2

(12) United States Patent
Shiue

(10) Patent No.: US 12,630,275 B2
(45) **Date of Patent: *May 19, 2026**

(54) BREATHABLE MASK

(71) Applicant: QBAS Co., Ltd., Taipei City (TW)

(72) Inventor: Chih-Cheng Shiue, Taipei City (TW)

(73) Assignee: QBAS CO., LTD., Taipei City (TW)

( * ) Notice: Subject to any disclaimer, the term of this patent is extended or adjusted under 35 U.S.C. 154(b) by 785 days.

This patent is subject to a terminal disclaimer.

(21) Appl. No.: 17/900,434

(22) Filed: Aug. 31, 2022

(65) Prior Publication Data

US 2023/0081616 A1 Mar. 16, 2023

Related U.S. Application Data

(60) Provisional application No. 63/326,418, filed on Apr. 1, 2022, provisional application No. 63/297,084, filed
(Continued)

(51) Int. Cl.

| | |
|---|---|
| ***B63C 11/16*** | (2006.01) |
| ***A63B 33/00*** | (2006.01) |
| *B63C 11/12* | (2006.01) |

(52) U.S. Cl.
CPC ..... *B63C 11/16* (2013.01); *A63B 33/002* (2013.01); *B63C 2011/125* (2013.01); *B63C 2011/128* (2013.01)

(58) Field of Classification Search
CPC ..... B63C 11/16; B63C 11/12; B63C 11/02; B63C 11/18; B63C 11/20; B63C 11/205; B63C 11/207; B63C 2011/165; B63C 2011/125; B63C 2011/126; A62B 18/00; A62B 18/02; A63B 33/002
See application file for complete search history.

(56) References Cited

U.S. PATENT DOCUMENTS

| | | | |
|---|---|---|---|
| 10,556,654 | B2 | 2/2020 | Cucchia |
| 10,668,999 | B2 | 6/2020 | Godoy |

(Continued)

FOREIGN PATENT DOCUMENTS

| | | | |
|---|---|---|---|
| DE | 202014011182 | U1 | 5/2018 |
| DE | 202014011183 | U1 | 5/2018 |

(Continued)

OTHER PUBLICATIONS

Standard DIN EN 1972 2016-02-00. Diving Accessories-Snorkels-Requirement and test methods; German version EN 1972:2015; date Feb. 1, 2016; pp. 1-10.

*Primary Examiner* — Colin W Stuart
(74) *Attorney, Agent, or Firm* — MUNCY, GEISSLER, OLDS & LOWE, P.C.

(57) ABSTRACT

A breathable mask includes a main frame, a transparent lens portion, a water-sealing skirt and a breathing tube. The main frame includes a lens frame, a mouth frame and a nose frame interposed therebetween. The water-sealing skirt is integrally formed by an eye skirt, a nose skirt and a mouth skirt, and a skirt frame is arranged in front of the eye skirt. The transparent lens portion and the skirt frame are embedded in the lens frame in a water-sealing manner, and the nose skirt protrudes outward from the nose frame. The transparent lens portion does not project outward from an outer edge of the lens frame at all.

13 Claims, 21 Drawing Sheets

Related U.S. Application Data on Jan. 6, 2022, provisional application No. 63/239,597, filed on Sep. 1, 2021, provisional application No. 63/305,938, filed on Feb. 2, 2022.

(56) References Cited

U.S. PATENT DOCUMENTS

| | | | | |
|---|---|---|---|---|
| 10,793,239 | B2 | 10/2020 | Caprice et al. | |
| 11,021,221 | B2 | 6/2021 | Godoy | |
| 11,225,308 | B2 | 1/2022 | Sorique et al. | |
| 2017/0334531 | A1 | 11/2017 | Shiue | |
| 2018/0134352 | A1 | 5/2018 | Armani et al. | |
| 2018/0297676 | A1* | 10/2018 | Zheng | B63C 11/16 |
| 2018/0319471 | A1 | 11/2018 | Thomas et al. | |
| 2019/0225311 | A1* | 7/2019 | Barone | B63C 11/16 |
| 2019/0358496 | A1* | 11/2019 | Shiue | A63B 33/002 |
| 2020/0115015 | A1* | 4/2020 | Sang | B63C 11/16 |
| 2020/0307749 | A1* | 10/2020 | Xiao | A61M 16/06 |
| 2021/0086882 | A1* | 3/2021 | Grimaldi | B63C 11/205 |
| 2021/0094662 | A1 | 4/2021 | Shiue | |
| 2021/0155328 | A1 | 5/2021 | Lucas | |

FOREIGN PATENT DOCUMENTS

| | | | |
|---|---|---|---|
| DE | 202014011184 | U1 | 5/2018 |
| DE | 202014011324 | U1 | 5/2019 |
| EM | 008655047-0001 | | 10/2021 |
| EP | 3140186 | B1 | 7/2019 |
| EP | 3604113 | A1 | 2/2020 |
| FR | 3064594 | A1 | 10/2018 |
| JP | S 46-38303 | | 11/1971 |
| TW | 200708443 | A | 3/2007 |
| TW | 201741201 | A | 12/2017 |
| TW | 201841796 | A | 12/2018 |
| WO | WO9803225 | A1 | 1/1998 |

* cited by examiner

BREATHABLE MASK

CROSS-REFERENCES TO RELATED APPLICATIONS

This patent application claims the benefits of U.S. Prov. Ser. No. 63/239,597 filed on Sep. 1, 2021, No. 63/297,084 filed on Jan. 6, 2022, No. 63/305,938 filed on Feb. 2, 2022, and No. 63/326,418 filed on Apr. 1, 2022. All of the above applications are incorporated by reference herein.

BACKGROUND OF THE INVENTION

Field of the Invention

The present invention is a full-face mask covering a user's eyes, nose and mouth, especially a breathable snorkeling mask that is relatively compact, lightweight and has excellent breathing efficiency.

Descriptions of the Related Art

In the current water activities, the most common way to allow a user to breathe freely without holding their breath is nothing more than using a mask (covering the eyes and nose) with a breathing tube (secured to the user's mouth). Although this method has been used for many years, it relies on the user to breath exclusively through the mouth. This however is different from the habit of ordinary people who breath from the mouth and or the nose. The invention of the face snorkeling mask 1 (i.e., the so-called Full Face Snorkel Mask, FFSM) is mainly to allow the body 10 of the mask 1 to cover the entire face F (from the eyebrows to the chin, including the eyes, nose, and mouth). Then, a breathing tube 11 connects to the central top of the body 10, and is in fluid communication with the inside of the body 10 for the user to breathe freely through the orinasal. The whole breathing process is more casual, and there is no need to pay attention to breathing, as shown in FIGS. 1A and 1B, making the water activities more enjoyable.

However, due to the large lens 12 area, the full-face snorkeling mask 1 has a large inner volume, making the FFSM difficult to carry. In addition, another fatal disadvantage of the large inner volume of FFSM is that during use, the large inner volume decreases the efficiency of exhaled air from leaving the FFSM; thereby the concentration of carbon dioxide in the total inner space of the mask body 10 will gradually increase. Inadvertent loss of consciousness due to insufficient content of blood oxygen has been reported all over the world. To understand why, we must start with some basic theories:

(1) The air we breathe contains about 21% oxygen ($O_2$) and up to about 0.04% carbon dioxide ($CO_2$). But many people don't know that it is carbon dioxide, not oxygen, that is primarily responsible for the rate and depth of our breathing; carbon dioxide is a very important component of the air in the human lungs, and increased levels of carbon dioxide can cause loss of consciousness. If this happens in water, the result is drowning.

(2) During breathing, oxygen is consumed and metabolized, and carbon dioxide is produced by our body, resulting in an increase in carbon dioxide content (to about 4%) and a decrease in oxygen content (to about 16%) in the air we exhale. When we exhale, the airway is not completely emptied, and a small amount of air (rich in carbon dioxide) remains in the airway. This amount of breathing that does not participate in air exchange is medically called "dead space". So, when we inhale again, we are breathing a mixture of air that includes "fresh air" as well as "air rich in carbon dioxide", can become lethal; therefore, we must keep the dead space as small as possible to be safe.

(3) To transplant such a theory to the FFSM, that is, to simulate the whole FFSM as the human respiratory system. When using the breathing tube 11 for breathing, the length of the airway is obviously increased, and conceptually, the volume of the so-called dead space is increased. If this total volume is too large, the air we rebreathe in will have increasingly higher concentrations of carbon dioxide, leading to the increased risks as described earlier. This is also the reason why the 1972 European Union Standard (i.e., EU standard EN 1972) strictly limits the length and diameter of breathing tubes; that is, the volume of breathing tubes for adults is required not to exceed 230 ml (and not to exceed 150 ml for children). And this is only the volume limit of the breathing tube 11. If we now add the internal volume of the mask body 10, the volume of the dead space will be doubled or tripled, or even higher, which will of course lead to the danger of increasing level of carbon dioxide concentration.

Based on the above theory, reducing carbon dioxide concentration has become a serious and active research and development for this industry, especially for well-known manufacturers, because they must produce safe and reliable products. Not only because of the need to pass the EU standard inspection, but also avoid being prosecuted and compensate people due to the safety concerns. These manufacturers usually go in two directions: 1) reduce the volume of dead space; 2) "shunt" the intake and exhaust air flowsof the mask, so that the fresh air inhaled is independent of the carbon dioxide exhaled, reducing the chance of mixing.

(1) In order to reduce the dead space, some FFSMs adopt the design concept of isolating the breathing portion (orinasal pocket) from other portions such as the cheeks and the eyes to form two areas, the upper portion is the upper volume (UV), that is, the eye pocket 14 (EP), as shown in the area surrounded by the hollow dotted line in FIG. 2; the lower portion is the lower volume (LV), which is the orinasal pocket 13 (OP), the area surrounded by the bold solid line in FIG. 2, allows the dead space to be stricty controlled only in the lower volume area, so as to reduce the carbon dioxide concentration.

(2) In order to divide the intake and exhaust, some FFSMs have designed a one-way breathing loop, by using a check valve to control one-way intake and one-way exhaust to prevent exhaled air from mixing inhaled fresh air. Therefore, when inhaling, it is ideal to only inhale "fresh air" from the breathing tube 11, pass through the eye pocket 14, and then pass through the check valve 15 to enter the orinasal pocket 13 (the path shown by the hollow dotted line in FIG. 3); The air can only be guided from the two sides of the mask body 10 to the top of the mask through a single passage (that is, the passages on the two sides of the body 10 along the outline of the lens frame, not shown in the drawings), and then discharged through the breathing tube 11, as shown by the solid dotted line in FIG. 3.

Even if the above-mentioned direction of solving the problem is correct the air tightness between the upper volume area (eye pocket 14) and the lower volume area (orinasal pocket 13) of many products is inherently not good due to aging materials, or due to different users' facial shapes and dimensions causing the seal between the upper and lower volume areas cannot be kept well at all. Only a simple partition exists between the eye pocket 14 and the orinasal pocket 13. In addition, not shown in the drawings for details, the passage occupied by the solid dotted lines in FIG. 3 will undoubtedly increase the volume of the dead space. This result returns to the level where the carbon dioxide concentration is too high. Of course, adding a check valve to control one-way exhaust so that the exhalation space can be reduced after deducting the volume of the eye pocket 14 can make up some shortcomings of excessive dead space, but, because the exhaust flow usually circulates from the two sides of the orinasal pocket, goes up along the air passages around the mask to the top of the mask, and then runs along the length of the breathing tube to the top of the breathing tube to be discharged. Whether this "one-way" control of exhaust can be well done all the way to the end, or whether it needs to be set some other check valves in the midway such as at the connection between the mask and the breathing tube, etc., will increase the cost of materials and make the mechanism more complicated.

With the current design of the FFSM, the entire lens is used to cover the eyes, nose, and mouth of the entire human face, and then on the inner side of the lens, various isolation, and air intake and exhaust mechanisms are arranged, Therefore, the lens surface must protrude forward from the frame to strive for more internal space, so the entire product will leave a certain distance from the user's face after wearing (as shown in FIG. 1B), and the internal volume of such a design of mask cannot be minimized. If it is desired to control the dead space to a lower range of values, it is even more impossible. Therefore, it is particularly important to make structural changes to the full-face mask existing in the market.

SUMMARY OF THE INVENTION

The primary purpose of the present invention is to provide a breathable mask, through structural changes, its volume can be minimized, therefore improving the above problems. To understand the technical thinking behind all of this, there are a few theories to focus on first.

The first is "negative ventilation pressure". In a relatively sealed room, if there is a one-way exhaust fan on one side of the wall to force the indoor air out, a transient relative vacuum (the so-called "negative pressure") will be formed. If the windows on the other side have many holes, the outdoor air will passively flow into the room with zero or negative pressure under the unbalanced internal and external atmospheric pressure. In this way, the indoor air is continuously circulated with the outdoor air. If the ventilation position is installed properly, or the temporary vacuum is more complete, the outdoor fresh air will flow toward the room through the holes "more naturally and actively", and the indoor air will only leave in the direction of being taken away and will not pollute other rooms. Industrial plants use this theory to purify the air in the factory. Medical institutions also use the same principle to build negative pressure isolation wards to ensure that patients with high infectious sources will not contaminate other rooms. The above theoretical relation is shown in the block diagram in FIG. 4.

The second is "Tidal volume". Tidal volume refers to the amount of air inhaled or expelled from the lungs during each breathing cycle and measures approximately 500 milliliters in a healthy adult male and approximately 400 milliliters in a healthy female. This is an important clinical parameter that allows for proper ventilation. When the lungs need adequate ventilation protection, the resting heart rhythm is used as the standard, and the tidal volume is set to 6-8 ml/kg ideal body weight (IBW). The safe tidal volume range is defined as 6-8 ml/kg IBW, where IBW (male)=50 kg+2.3× (height (in inch)−60). Using this algorithm, the calculated safe tidal volume for a man with a height of 185 cm is between 474 ml and 632 ml; while for a man with a height of 165 cm, the calculated safe tidal volume is between 368 and 490 ml. This is why the average safe tidal volume for a healthy adult male is set at about 500 ml in clinical practice.

Based on the knowledge of negative pressure ventilation technology, after wearing the FFSM, a negative pressure space is formed between the mask and the face, and the action of the user's exhalation can be compared to a one-way exhaust fan. When the air is activated (that is, exhaling), if all the air in the mask can be exhaled, it will be closer to the transient vacuum state. At this time, the air flow of the intake air will passively flow into the mask "naturally and actively". Air bringing in from the outside is the fresh air, while air discharged from the mask is the dirty air of carbon dioxide that is not expected to remain in the mask. It does not require forced inhalation to form a natural and clean cycle with separation of intake and exhaust. Based on the knowledge of tidal volume, if the user can exhale all the air in the mask with every exhalation, a vacuum-like transient will be formed in the mask, and the above-mentioned clean cycle can be easily achieved. According to this important finding, if an adult male is taken as an example, as long as the total of the volume in the mask plus the volume in the breathing tube (that is, the dead space as understood above) can be as small as 500 ml or less, or even better to be lower than 300-400 ml, it can ensure that each resting exhalation volume of the user (no matter whether adult male, female or child) reaches a transient vacuum rate close to 100%, then the next inhalation will not be laborious, and the fresh air brought in can fill the entire dead space. With the effect of negative pressure exhaust, there will be rigidly any mix with dirty carbon dioxide air, so there is no safety concern.

Another objective of the present invention is to provide a breakthrough structure to minimize the interior of the body of the existing diving/snorkel mask, so that the body boundary can be concentrated in the middle of the face, as long as the eyes, nose and mouth are covered, well positioned and waterproofed. In other words, the structure of the orinasal pocket for accommodating the user's nose and mouth is independent of the lens frame, instead of letting the entire transparent lens 12 protrude from the whole face frame 18 as in the traditional FFSM (in reference to FIGS. 1A and 1B) whose basic structure is to divide the eye pocket and the orinasal pocket inside the mask behind the entire lens 12. In this invention, because there is no wasted space, and the eye mask portion and the orinasal mask portion are independent of each other, the eye mask can be as close to the eyes as possible, and the orinasal mask can also be as close as possible to the user's orinasal. This way, the upper, lower, left, right, front, and rear dimensions are not overextended, and the overall internal volume is naturally and effectively reduced. This solves the fundamental problem of excessive dead space. Consequently, the overall weight is thus greatly reduced, making it more convenient to carry. Further, in such a design of the breathable mask, the nose portion, which can be made of soft material and exposes outward, makes it possible to allow the user to operate the function of equalization that only the conventional diving mask overing the user's eyes and nose can have.

Because the internal volume of the entire mask can be extremely effectively reduced, some additional designs, such as how small the lower volume is, how the orinasal pocket should be designed, whether the upper and lower volume areas are effectively isolated, whether to design check valve control to shunt the intake and exhaust, and whether the breathing tube must strictly control its internal volume, have become secondary issues. Dealing with these secondary issues will only further improve the effect of circulation. In addition, because the orinasal pockets have been significantly reduced in volume, the exhalation efficiency will be greatly improved; that is to say, it is not necessary to use too much force for exhalation, and at the same time, the accumulated water in the orinasal volume area can be drained easily. Furthermore, to fix the traditional FFSM on the user's head, on both sides of the entire mask frame, there must be a total of four points (16 and 17 in FIG. 2) provided to allow the head strap (not shown) to cross the back of the head. It is very troublesome and bulky to fix. On the contrary, in this invention, because the main weight will fall on the eye mask area, i.e., the weight shared by the orinasal mask is relatively low, so the two-ended head strap traditionally used for a diving mask suffices to fasten the mask onto the user's head from two opposing sides of the lens frame around the back of the head. The convenience of carrying and use is greatly improved, and the cost of manufacturing is also reduced.

DESCRIPTION OF THE PREFERRED EMBODIMENT

First of all, it is explained that the head strap that is fixed to the two sides of the frame around the user's head are easily obscured or interfered with some important components and affect the description. Therefore, except for FIGS. 9A, 11A and 11C, the head strap is omitted in the other figures.

Figure 5A:
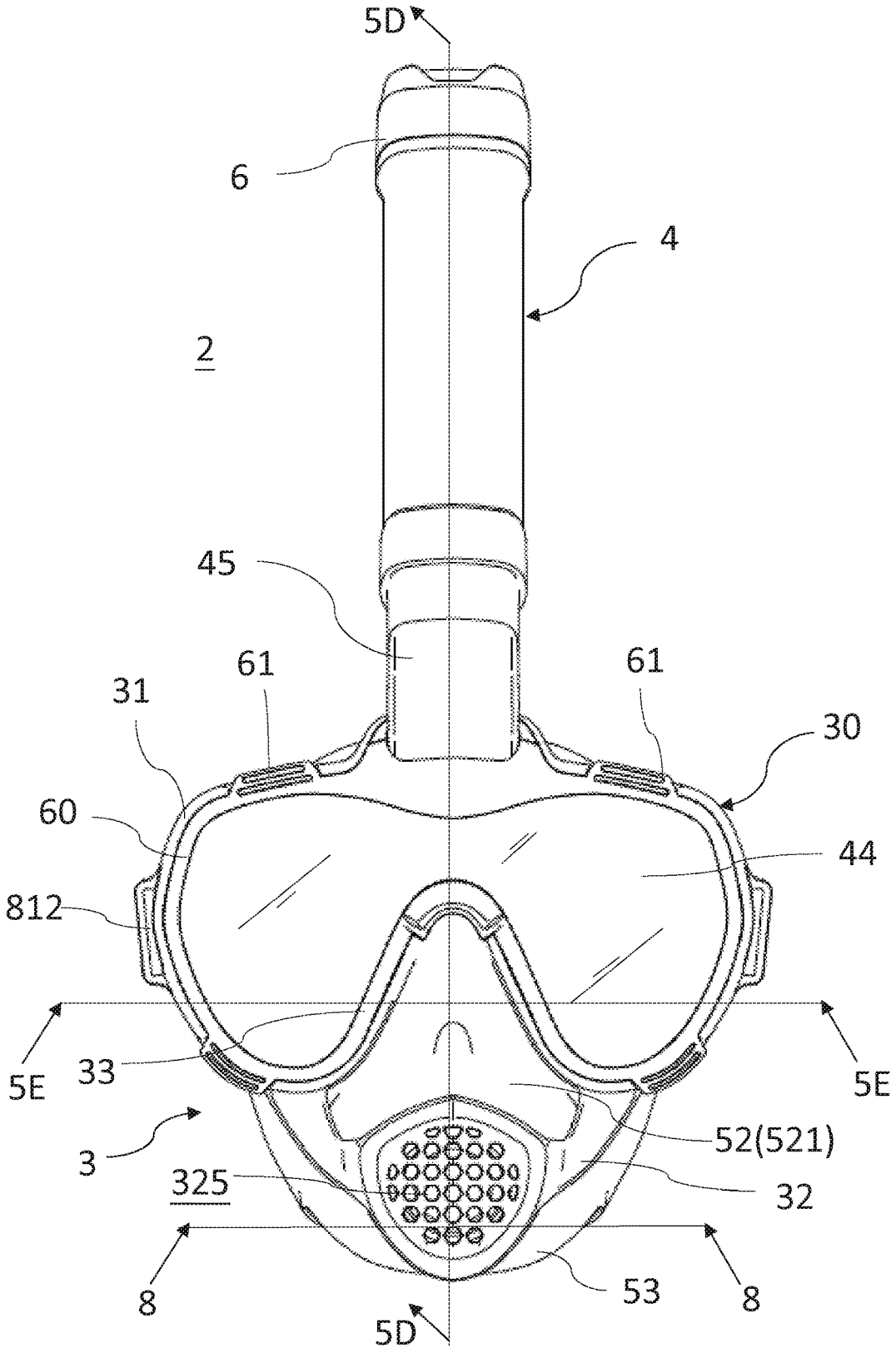
FIG. 5A is a schematic front view of an embodiment of the present invention.
Figure 5B:
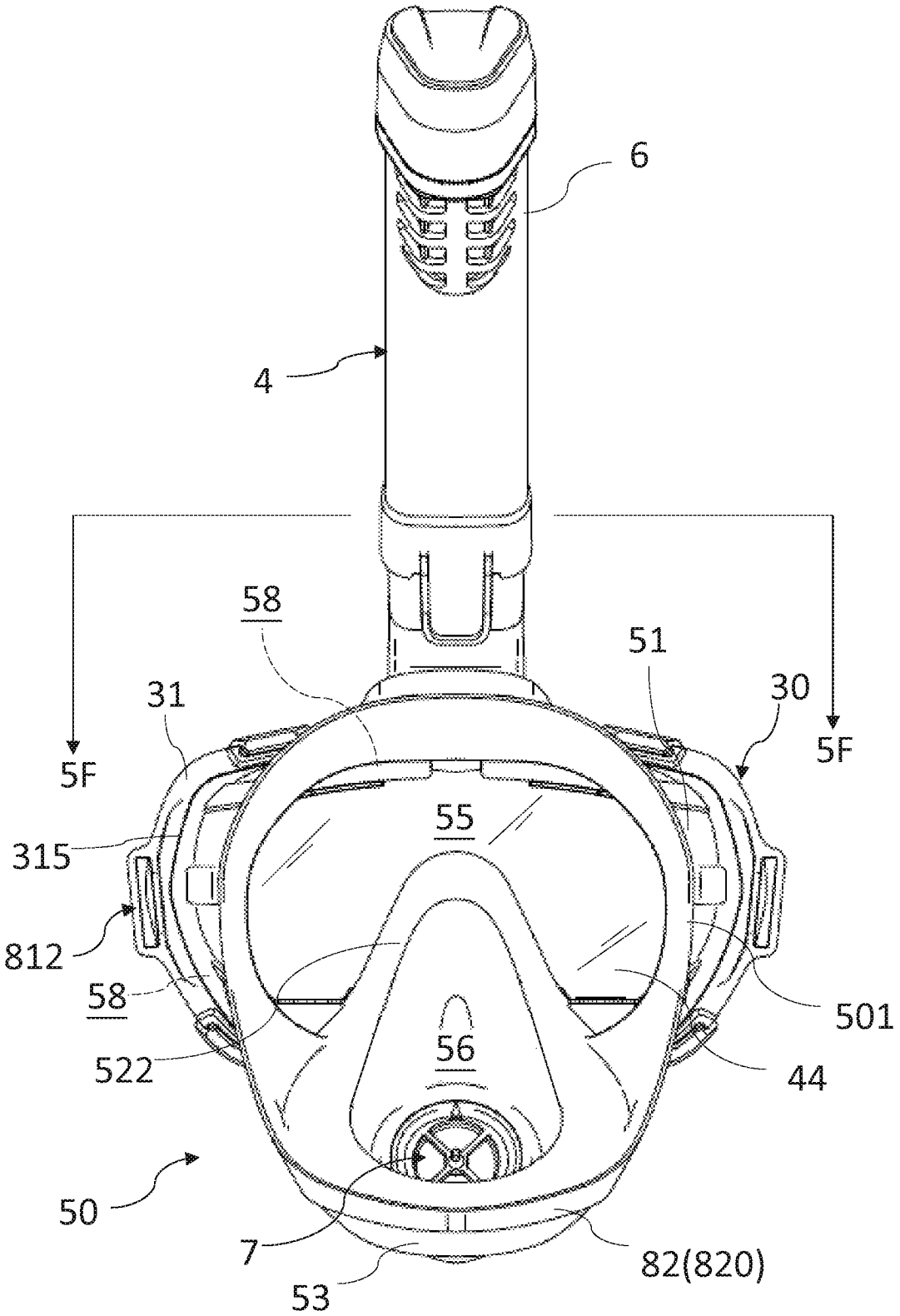
FIG. 5B is a schematic diagram of the rear view of FIG. 5A.
Figure 5C:
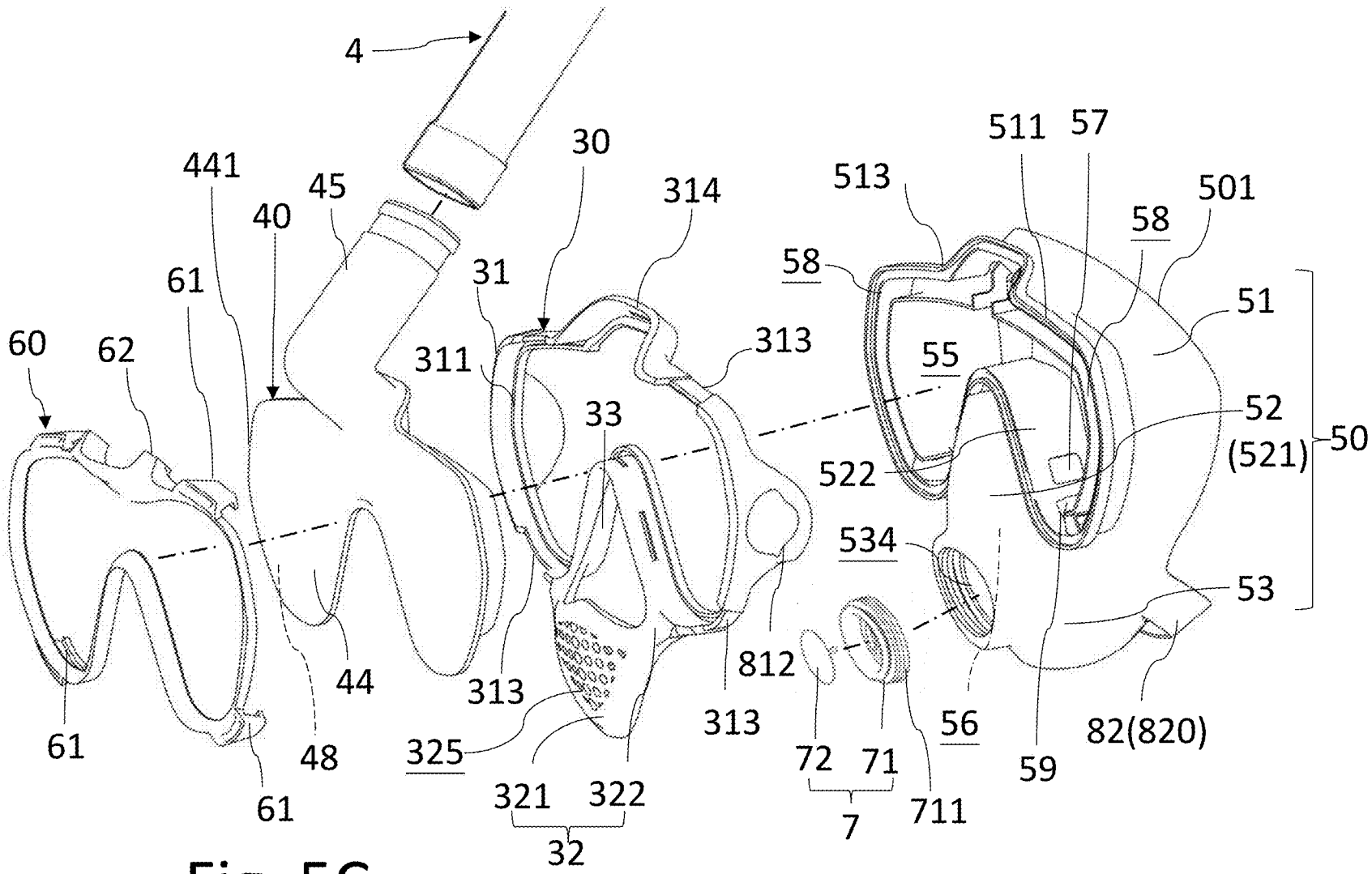
FIG. 5C is a perspective exploded schematic view of FIGS. 5A and 5B, wherein the breathing tube only shows a portion of the tube body.

FIGS. 5A, 5B and 5C show the basic structure of the mask 2 of the present invention. The breathable mask 2 includes a body 3 and a breathing tube 4. The breathing tube 4 is an existing breathing tube, such as a dry snorkel. When the top 6 sinks below the water surface, no water will flow into the breathing tube 4, and when the top 6 rises to the water surface, the breathing tube 4 can be connected to the body 3 for air exchange between a user wearing the mask 2 and the outside.

The body 3 includes a main frame 30, a lens module 40 and a water sealing skirt 50. The main frame 30 and the lens module 40 are preferably made of rigid materials, while the water sealing skirt 50 is preferably made of flexible soft materials to achieve good waterproofness and wearing comfort. The main frame 30 has a lens frame 31 and a mouth frame 32, and the mouth frame 32 has a shield 321 and two brackets 322 respectively extending from the lower two sides of the lens frame 31 and connected to the shield 321. The shield 321 and the two brackets 322 of the mouth frame 32 together define a nose frame 33 along with the lens frame 31, and the shield 321 of the mouth frame 32 is in fluid communication with the outside. The lens module 40 has a transparent lens portion 44 having a shape corresponding to the shape of the frame 31. The water sealing skirt 50 is formed, preferably integrally formed with an eye skirt 51, a nose skirt 52 and a mouth skirt 53. The front of the eye skirt 51 has a skirt frame 511 having a shape corresponding to the shape of the transparent lens portion 44. The transparent lens portion 44 and the skirt frame 511 are jointly waterproof and embedded in the lens frame 31, and the nose skirt 52 protrudes outward from the nose frame 33. The mouth skirt 53 is adapted to be in one-way fluid communication with the outside through the mouth frame 32. When the user wears the breathable mask, the eyes (E), nose (N), and mouth (M) are respectively accommodated in the eye skirt 51, the nose skirt 52 and the mouth skirt 53, and are continuously enclosed by the rear edge 501 of the water sealing skirt 50 along an outer periphery thereof, thereby the water sealing skirt 50 is in close contact with the user's face (F), as shown in FIG. 5D.

Figure 5D:
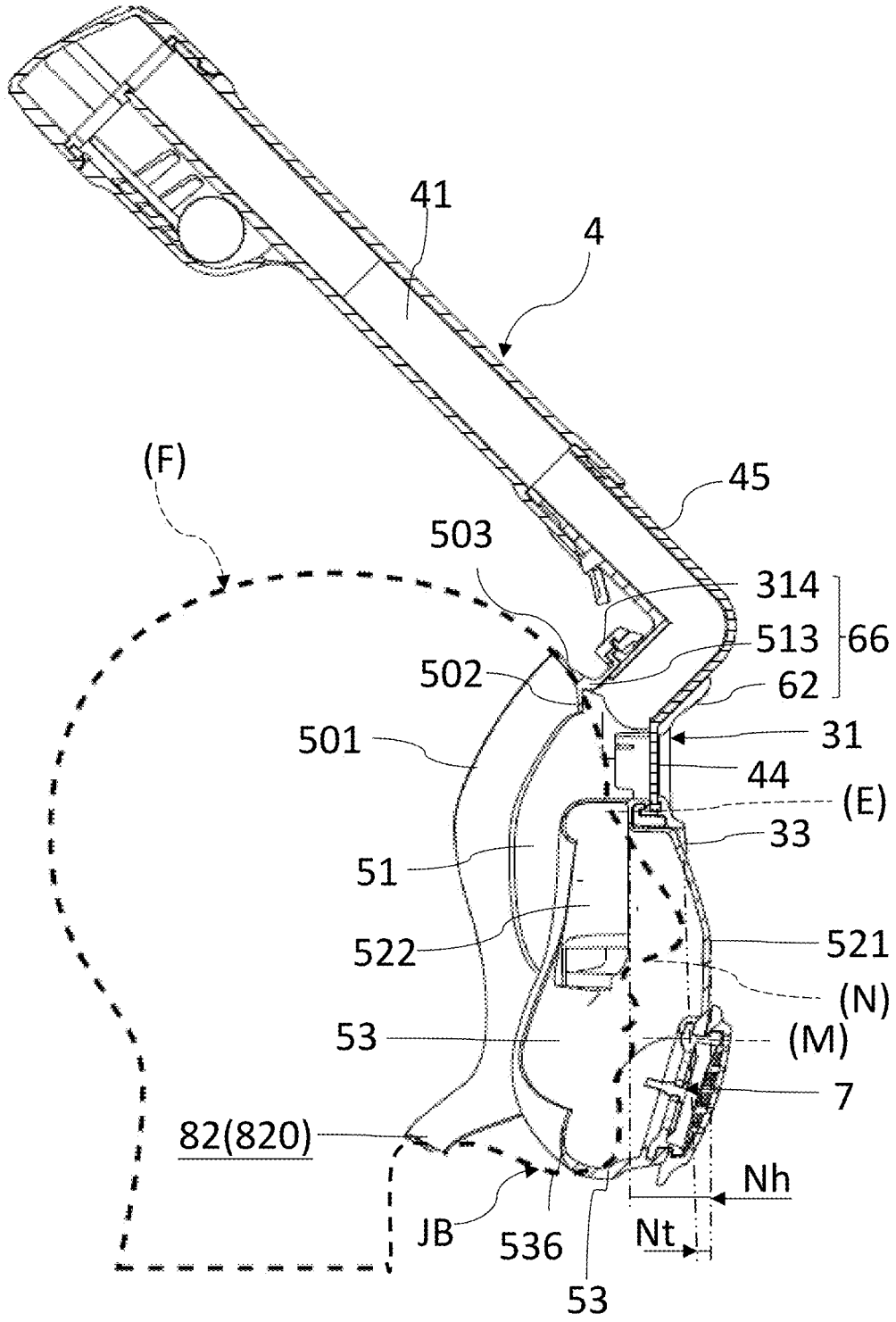
FIG. 5D is a schematic view of a user wearing the breathable mask of the present invention, wherein the breathable mask shows its sagittal plane taken from the Line 5D-5D of FIG. 5A.
Figure 5E:
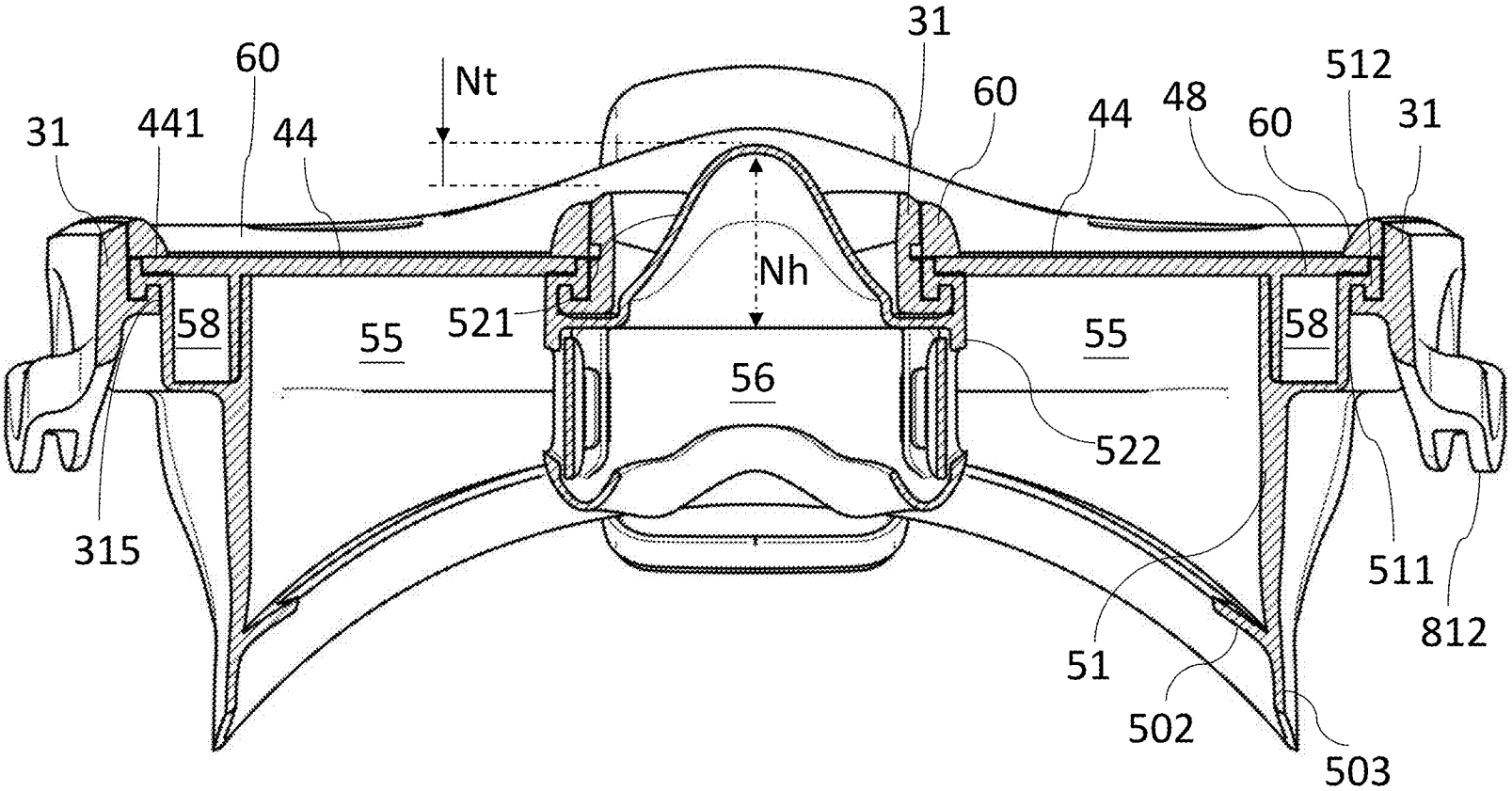
FIG. 5E is a schematic cross-sectional view taken from Line 5E-5E of FIG. 5A.

Preferably, further in reference to FIG. 5E, the body 3 further includes a sub-frame 60. The lens frame 31 has a rigid inner flange 311, the skirt frame 511 has a soft flange 512 corresponding to in shape and overlapping the inner flange 311. The transparent lens portion 44 has an outer peripheral edge 441 overlapping the soft flange 512. The sub-frame 60 overlaps the outer peripheral edge 441 of the transparent lens portion 44, and is fastened with the lens frame 31. This way, the transparent lens portion 44 and the skirt frame 511 are waterproof and embedded in the lens frame 31 together. Preferably, the sub-frame 60 and the lens frame 31 are fastened by clips 61 and 313 as shown in FIG. 5C for detachable or permanent fixing, or by any forms of adhesion. Of course, the lens frame 31 and the sub-frame 60 can be designed into one piece or into multiple pieces, as long as they can be combined with the transparent lens portion 44 and the skirt frame 511 to achieve appropriate sealing and waterproofing. In addition, in reference to FIGS. 5B and 5E, the nose skirt 52 includes an equalizing portion 521 and a partition 522, which are separated by a section of the lens frame 31. The eye skirt 51, the transparent lens portion 44 and the partition 522, which together define an eye pocket 55 (i.e., the upper volume of the body 3), whereas the equalizing portion 521, the partition 522 and the mouth skirt 53 jointly define an orinasal pocket 56 (i.e., the lower volume of the body 3). Furthermore, an exhaust passage 58 is disposed along an inner peripheral edge 315 of the lens frame 31. The exhaust passage 58 is defined by the eye skirt 51 and a surface of an outer peripheral edge 441 of the transparent lens portion 44, and is in fluid communication with the breathing tube 4 at an upper end thereof, and in fluid communication with the orinasal pocket 56 at a lower end thereof, as more clearly seen with reference to FIG. 5F. Of course, the above-mentioned exhaust passage 58 can also be added up to (but not limited to) two passages, respectively formed on both sides of the eye skirt 51 and being in fluid communication with the orinasal pocket 56 through the exhaust openings or exhaust check valves 59. The following is the exampled structure where the upper end of the exhaust passage 58 is in fluid communication with the breathing tube 4. Specifically, the lens module 40 additionally includes a connector 45, which is inserted through an assembled sleeve 66 which is formed by the top portions 314, 62, 513 of the lens frame 31, the sub-frame 60, and the water sealing skirt 50, respectively, as shown in FIGS. 5C and 5D. When the user inhales, the exhaust check valve 59 is closed, and the clean air enters the eye pocket 55 from the intake duct 41 of the breathing tube 4, enters the orinasal pocket 56 through the intake check valve 57, and then enters the user's nostrils and mouth, as shown by the hollow dotted line in FIG. 5F. When the user exhales, the intake check valve 57 is closed, and the dirty air enters the exhaust passage 58 through the exhaust check valve 59, and then exit through the exhaust duct 42 of the breathing tube 4 as shown by the solid dotted lines in FIG. 5F.

Furthermore, as seen from FIGS. 5D and 5E, the rear edge 501 of the eye skirt 51 of the water sealing skirt 50 has a specific shape to better fit the user's face (F). Preferably, the rear edge 501 is configured to have a Y-shaped cross section which includes a first fitting portion 502 inside and a second fitting portion 503 outside. When wearing the mask, the included angle between the first fitting portion 502 and the second fitting portion 503 is elastically opened and in close contact with the user's face, whereby being equivalent to provide two layers of waterproof protection. This two-layer waterproof protection does not end until it reaches the position of the mouth skirt, which not only provides excellent waterproofness of the mask, but also makes the user's eyes (E) be closer to the transparent lens portion 44, which undoubtedly provides further help for the miniaturization of the space inside the body 3 of the mask 2, as opposed to the existing FFSM using the folded rear edge of the water sealing skirt that needs a larger peripheral space.

The following Table A having no users is a comparison list which are measured for the inner volume of the body 3 of the mask 2, i.e., the eye pocket (EP) volume and the orinasal pocket (OP) volume in one of the optimal products of the present invention, as opposed to that of the commercially available full-face snorkel mask, by using the computer-aided design of DASSAULT SYSTÈMES Software named "CATIA V5", under the same environmental conditions; whereas Table B is another comparison list after a user (according to ISO standard adult male head) wear those masks and the remaining eye pocket volume (REP) and the remaining orinasal pocket volume (ROP) are measured. Among them, each of the volume units is "ml".

TABLE A

| Brand | Model | Eye pocket volume (EP) | Orinasal pocket volume (OP) | Total inner volume (EP + OP) |
|---|---|---|---|---|
| WHQQDOC | S/M | 509 | 272 | 781 |
| DECATHLON | EASY BREATH | 399 | 206 | 605 |
| MARES | SEA VU DRY | 426 | 317 | 743 |
| BODY GLOVE | AIRE | 435 | 279 | 714 |
| CRESSI | BARON | 840 | 328 | 1,168 |
| Product of this invention | | 229 | 158 | 387 |

TABLE B

| Brand | Model | Remaining Eye pocket volume (REP) | Remaining Orinasal pocket volume (ROP) | Total remaining inner volume (REP + ROP) |
|---|---|---|---|---|
| WHQQDOC | S/M | 462 | 169 | 631 |
| DECATHLON | EASY BREATH | 327 | 168 | 495 |
| MARES | SEA VU DRY | 391 | 266 | 631 |
| BODY GLOVE | AIRE | 384 | 239 | 623 |
| CRESSI | BARON | 739 | 308 | 1,047 |
| Product of this invention | | 206 | 83 | 289 |

The above experimental data says that that the body 3 of the present invention reduces its internal volume a lot. Even if a slight volume (less than 100 ml) occupied by the exhaust ducts in the breathing tube 4 is added up, the real volume in total is still close to or even lower than the tidal volume of ordinary people. Therefore, no matter how the interior of the body 3 is designed, the snorkeler can almost empty the dirty air in the mask 2 as long as he/she exhales moderately, forming a transient vacuum state. Physically, the clean air outside has been waiting to enter this negative pressure environment. As long as the user breathes naturally, the clean air from the outside can be brought into the mask body 3, thus forming an easy inhalation and exhalation cycle, which is not easy to have the user lose energy. And there is no danger resulting from excessive carbon dioxide content. This mask design makes the entire lower half of the body 3, that is, the region from the lower portion the lens frame 31 all the way downwards to the nose skirt 52 and the mouth skirt 53, obviously becomes thinner and sharpened in width, as shown in FIG. 5A. This causes the whole snorkeling mask to become much smaller than the existing full-face mask 1, and it is more portable to carry. The following Table C is the actual measurement data (unit: mm) of the internal space of the body of various masks, which is sufficient to prove the excellent size down of the present invention.

TABLE C

| Brand | Model | Max. inner width (W) | Max. inner height (H) | Max. inner depth (D) |
|---|---|---|---|---|
| WHQQDOC | S/M | 155 | 204 | 77 |
| DECATHLON | EASY BREATH | 147 | 176 | 70 |
| MARES | SEA VU DRY | 155 | 203 | 88 |
| BODY GLOVE | AIRE | 144 | 178 | 76 |
| CRESSI | BARON | 155 | 210 | 89 |
| Product of this invention | | 140 | 130 | 44 |

Figure 6:
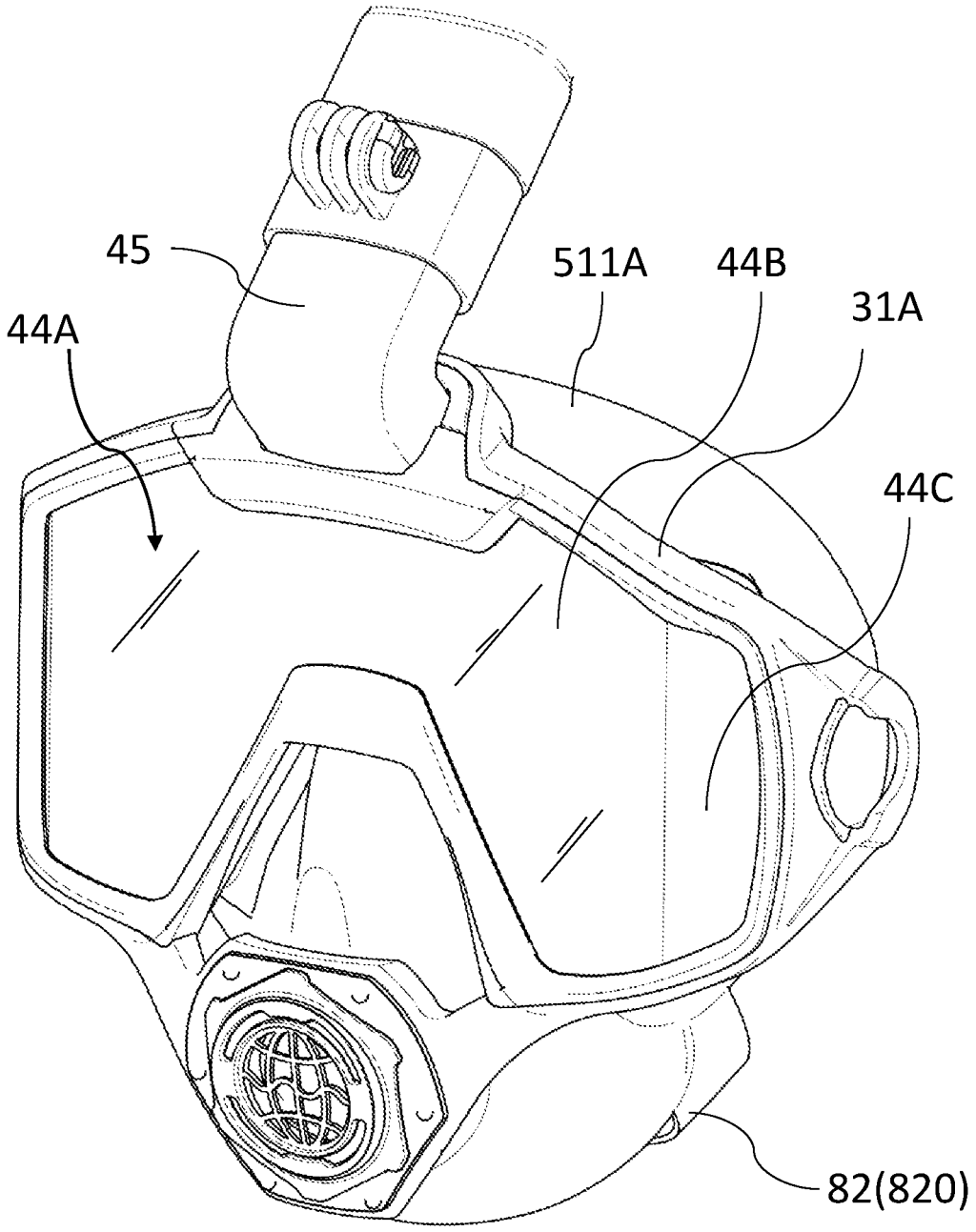
FIG. 6 is a three-dimensional schematic diagram of another embodiment of the present invention (angular-bending lens module)

As shown in FIGS. 5D and 5E, because of the above-mentioned structural arrangement, the transparent lens portion 44 in the breathable mask 2 of the present invention does not protrude from the outer edge of the lens frame 31 at all. Therefore, the transparent lens portion 44 can be closer to the user in order to achieve the excellent REP and ROP values with a small inner volume of the mask body 3 mentioned above. The mentioned transparent lens portion 44 which does not protrude from the outer edge of the frame 31 is not limited to the full-flat lens module as shown in FIGS. 5A-5E, but also applies to other styles, such as a angular-bending lens with a straight corner, or a curved lens with an arc corner. Taking a angular-bending lens portion as an example, in reference to FIG. 6, both of an angular-bending lens frame 31A and an angular-bending lens 44A need be matched with each other. The angular-bending lens 44A includes a flat portion 44B and two bending portions 44C respectively extending backwards from two opposing sides of the flat portion 44B. It is required that the skirt frame is a angular-bending skirt frame 511A, while the shapes of the angular-bending frame 31A, the periphery of the angular-bending lens 44A, and the angular-bending skirt frame 511A correspond to one another to facilitate mutual water seal fitting.

Figure 5F:
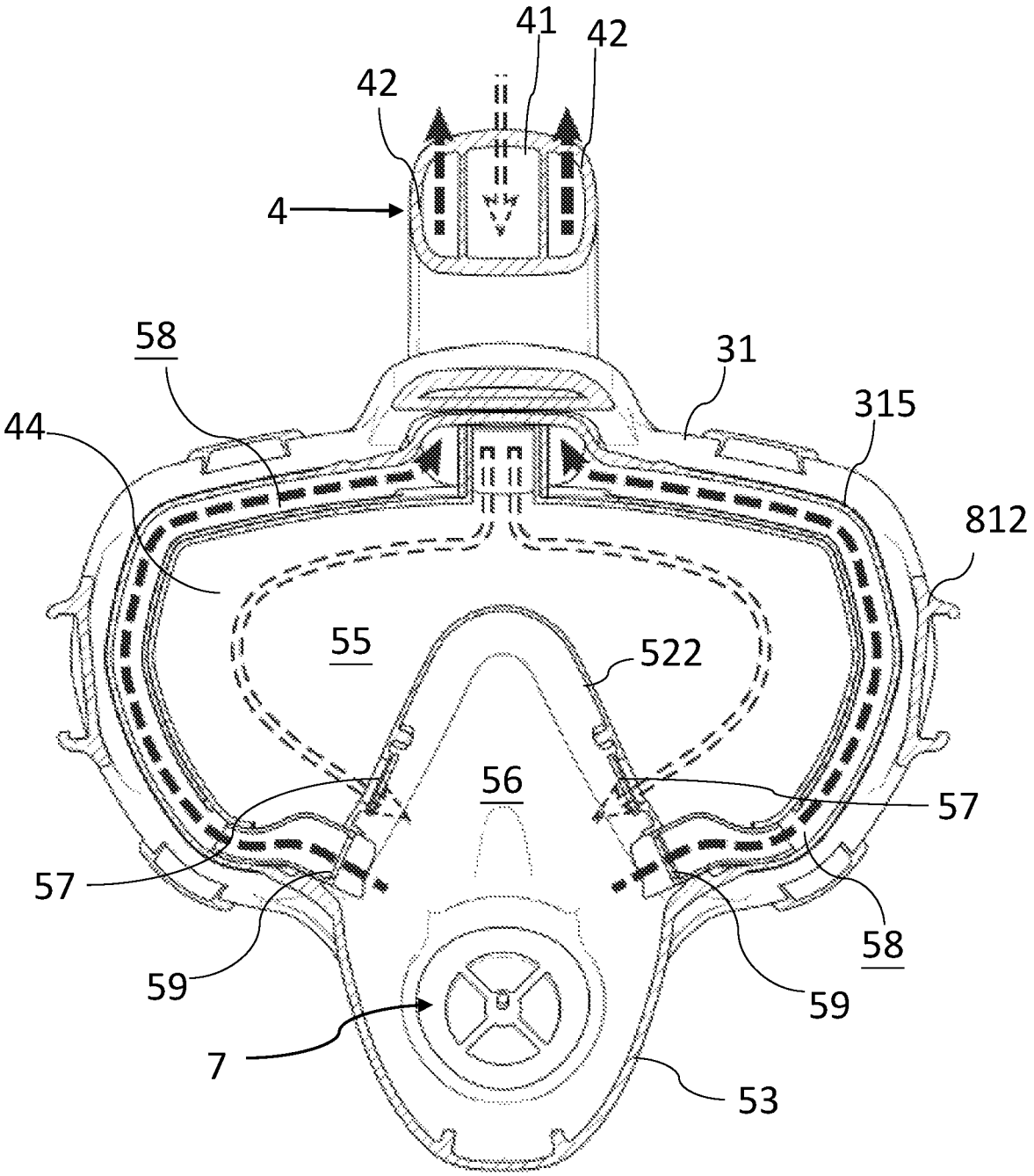
FIG. 5F is a schematic cross-sectional view, the coronal plane taken from Line 5F-5F of FIG. 5B.

In addition, when using a snorkeling mask, if the shunt measures of intake and exhaust as shown in FIG. 5F are adopted, the amount and efficiency of inhaled clean air are as important as the exhaust efficiency. The above negative pressure transient vacuum theory is related to the exhaust efficiency (that is, whether the dirty air can be fully evacuated), but if the next intake cycle can be further improved, undoubtedly, the entire mask intake and exhaust cycle must reach an optimum. Geometrically, under the same area, a rectangle occupies less space than a circle. Therefore, a rectangular valve that pivots on one side thereof is physically easier to be configured in a limited space (e.g., on the partition dividing the eye pocket and the orinasal pocket), as compared to a center-fixed circular mushroom-shaped check valve. Furthermore, the rectangular valve can receive air intake with a better opening angle. The present invention already has a breakthrough and small internal volume, and if the pivot intake check valve is used to provide the unidirectional fresh air from the eye pocket to the orinasal pocket, the amount of intake air is greatly increased and the user's energy is saved.

Figure 7A:
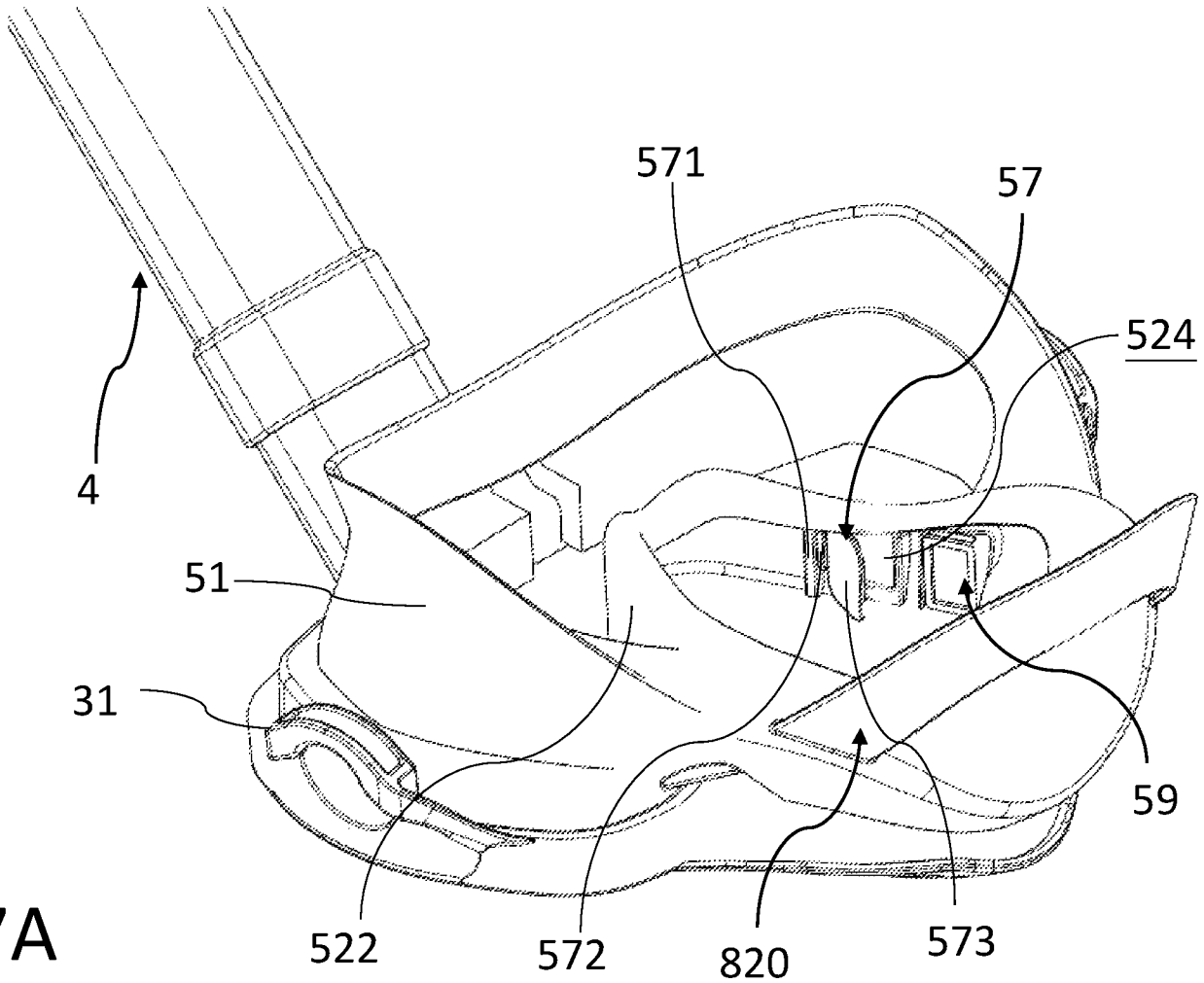
FIG. 7A shows the state of the pivot valves during inhalation of the present invention.
Figure 7B:
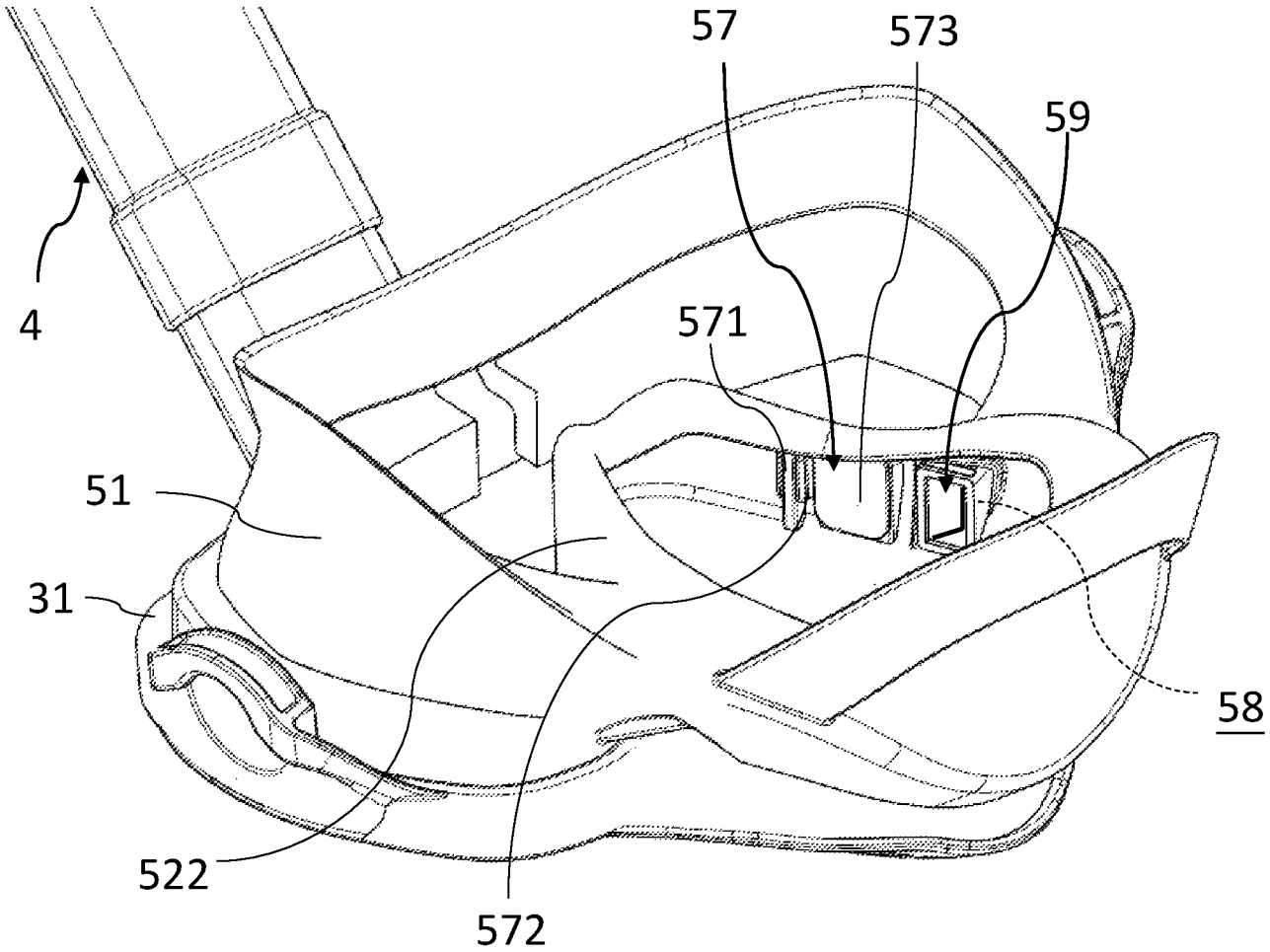
FIG. 7B shows the state of the pivot valves during exhalation of the present invention.

The description as to the pivoting check valve is as follows. First, each mask 2 is provided with at least one (on the left or the right), preferably two (one on each on the left and the right) air intake check valves 57. More preferably, each mask 2 is provided with four pivot check valves, in which two for the air intake are symmetrically disposed on the upper portion of the partition and have a larger size, and the other two for the air exhaust are symmetrically disposed on the lower portion of the partition and having a smaller size than the intake check valves. Now one of the intake check valves 57 arranged in the partition 522 is taken as an example to illustrate, whereas the exhaust check valve 59 like the exampled intake check valve 57 can be set at any position of the exhaust passage 58, such as at the entrance thereof, as shown in FIGS. 7A and 7B, or at the position of the exhaust duct at the top of the breathing tube 4 (not shown). The valve 57 includes a fixing portion 571 and a pivot axle 572. The fixing portion 571 is installed on the side of the air inlet 524 formed on the partition 522. The pivot axle 572 does not necessarily need to be substantially installed with a hinge or a pin. It is possible to directly thin the thickness on one side of the swing lid 573 (the optimum thickness is 20%-60% of the thickness of the swing lid 573), making it a weak zone for bending, as shown in FIGS. 7A and 7B. Then the effect of pivoting the swing lid 573 can be achieved. When the swing lid is activated by air flow, it will naturally pivot about the weak zone serving as the axis of pivot to open or close the swing lid. If the installation method is appropriate, the swing lid 573 naturally opens slightly due to its own weight, so as to help the air intake in advance. When the user inhales with a moderate force (as shown in FIG. 7A), the intake check valve 57 is opened and the exhaust check valve 59 is closed. This way may just have the swing lid 573 be easily opened about 40-70 degrees. If the user exhale or inhale more deeply, the swing lid 573 can be opened to an extent about 60-70 degrees that will lead an amount of air flow being almost equivalent to the amount of air passing through the air inlet 524 without installing the swing lid 573. The same is true when the user exhales, as shown in FIG. 7B, except that the intake check valve 57 is closed and the exhaust check valve 59 is opened. The swing lid 573 is not limited to rectangle, any other shapes such as square, trapezoid, polygon, circle, semicircle, oval, triangle, or even irregular shapes are applicable, as long as it is a single-sided pivoting lid in installed either in a free or auto-resiling manner. If the swing lid 573 adopts the recommended rectangle, its width and height is preferably set between 5 mm and 30 mm, and the thickness is preferably set between 0.3 mm and 3 mm, which is the most space-saving and easiest to open and close naturally according to the user's inhalation and exhalation. The size of the air inlet 524 covered by the swing lid 573 should be slightly smaller than that of the swing lid 573.

Figure 1B:
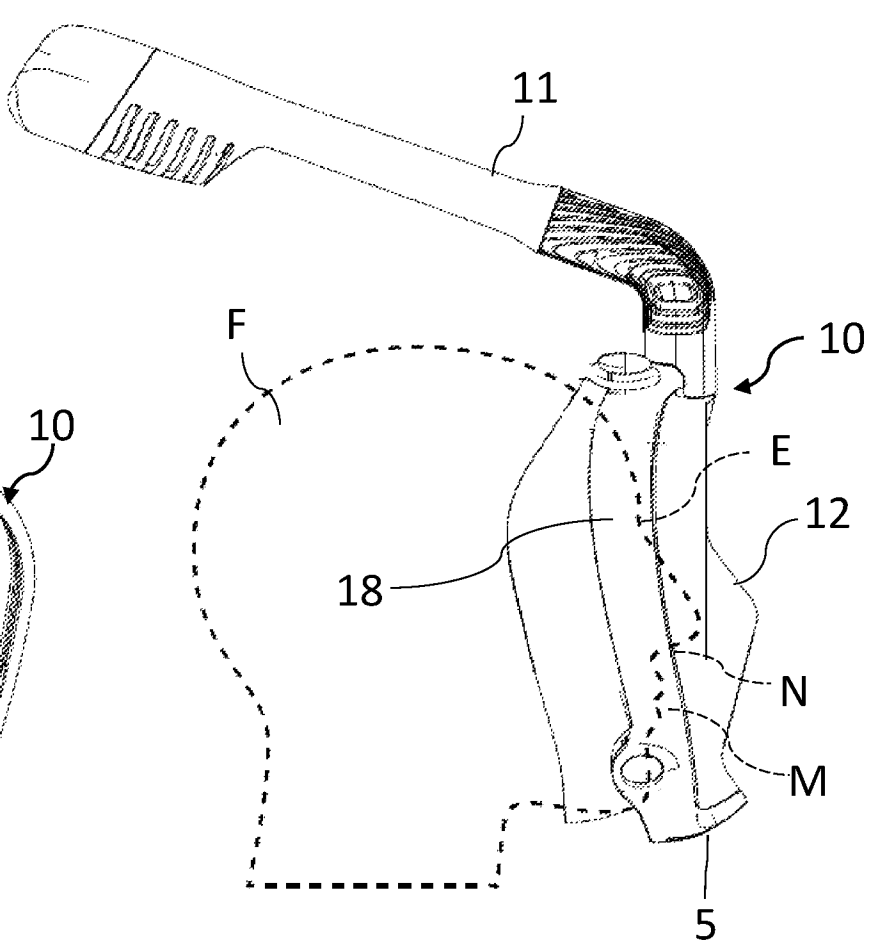
Fig. 1B (Prior Art)
FIG. 1B is a schematic side view of a user wearing a traditional full-face snorkeling mask.
Figure 1A:
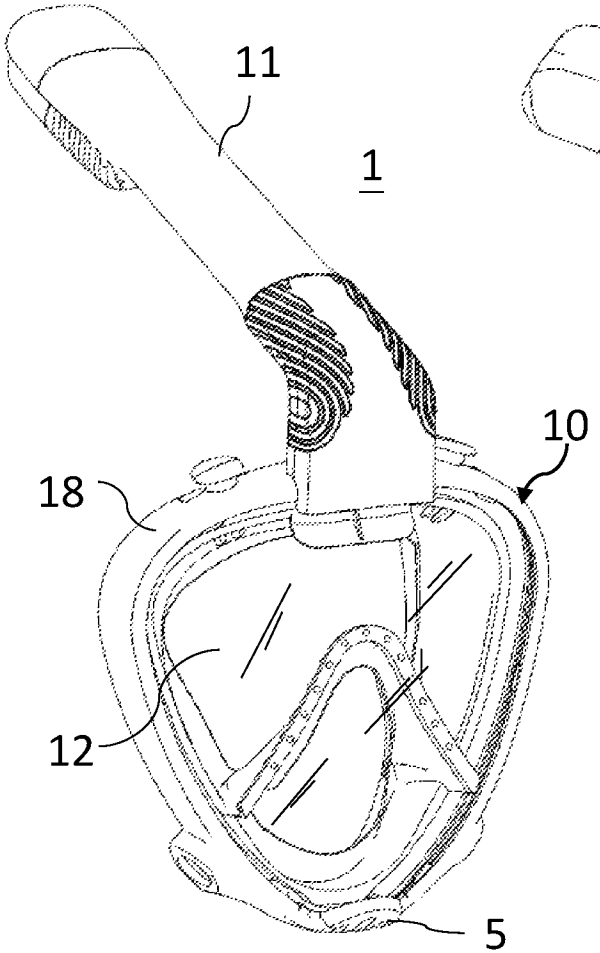
Fig. 1A (Prior Art)
FIG. 1A is a schematic, perspective view of a traditional full-face snorkeling mask.
Figure 3:
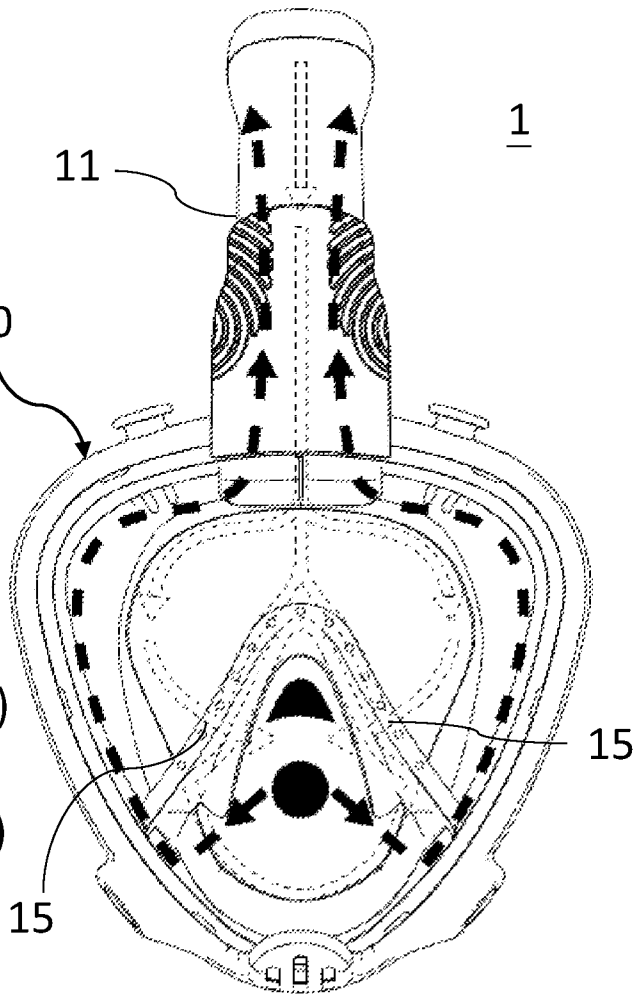
Fig. 3 (Prior Art)
FIG. 3 is a schematic diagram of the inlet and outlet air paths of FIG. 2.
Figure 2:
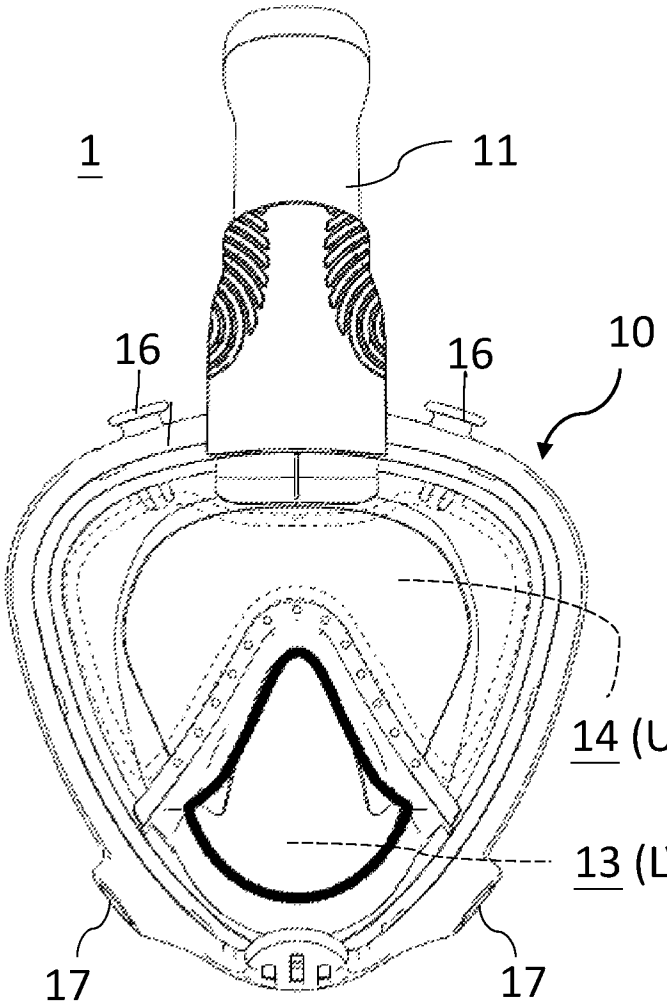
Fig. 2 (Prior Art)
FIG. 2 is a schematic diagram showing the upper and lower volume divisions of a traditional full-face snorkeling mask.
Figure 4:
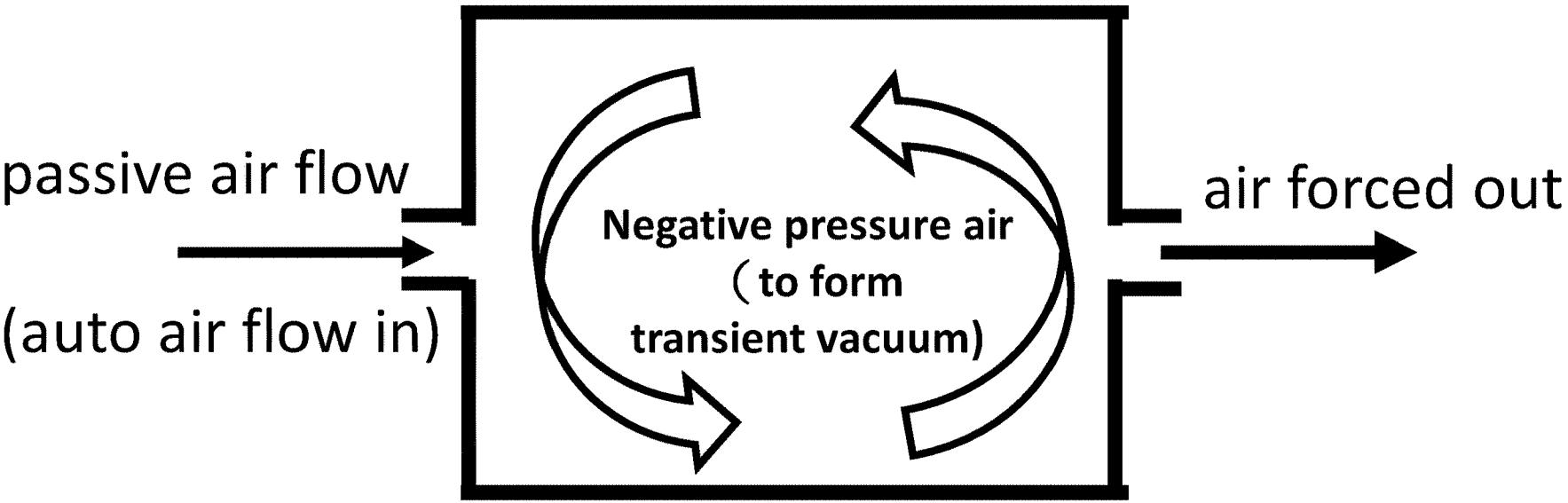
FIG. 4 is a block conceptual diagram showing the negative pressure ventilation theory.
Figure 8:
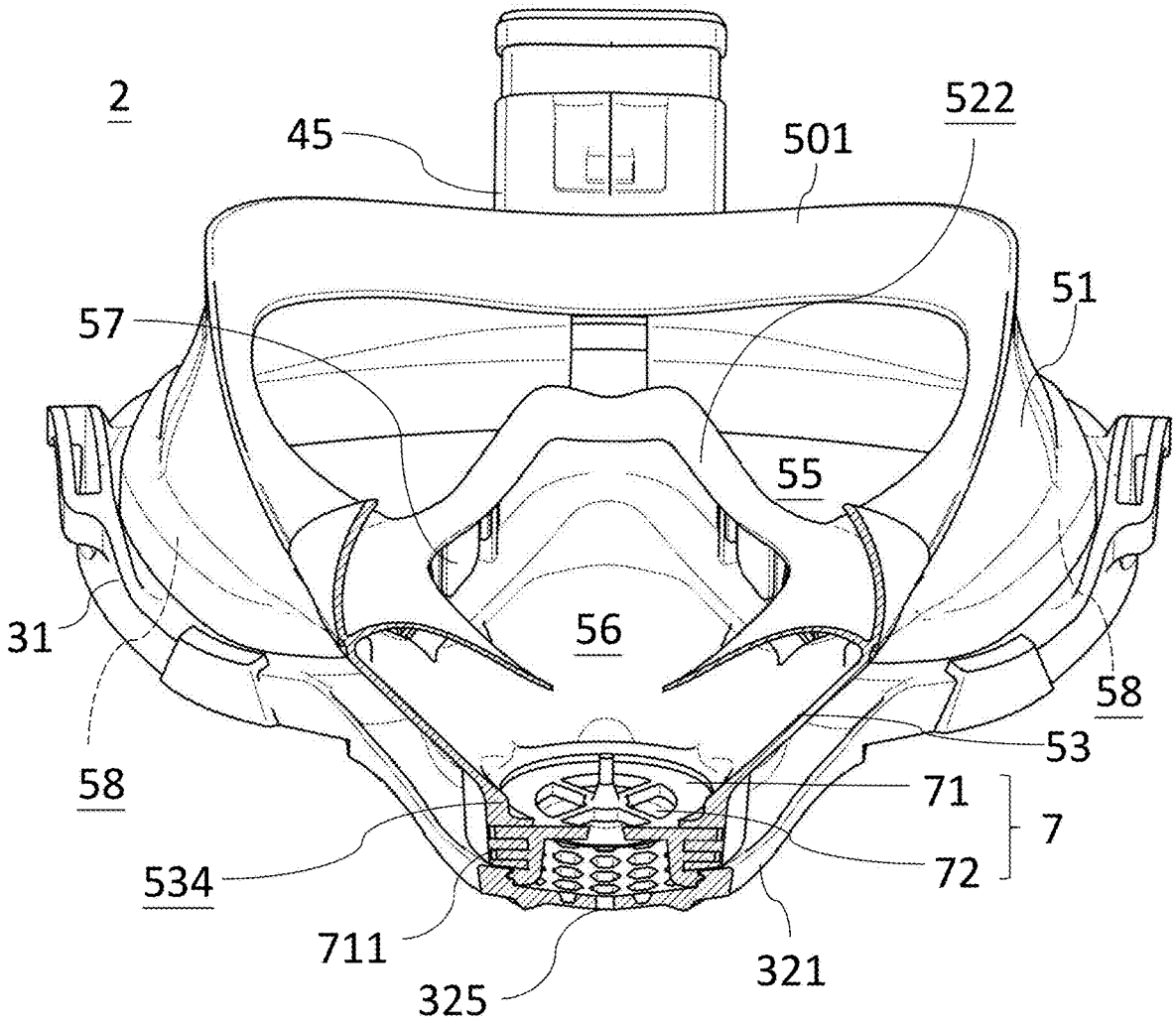
FIG. 8 is a schematic cross-sectional view taken from Line 8-8 of FIG. 5A.

Compared with the prior art, the purge valve of the present invention is obviously more efficient in purging water and air out from the user's mouth. Further, in reference back to FIGS. 5A, 5C, and 5D, a plurality of apertures 325 (unlimited in number) are formed on the shield 321 of the mouth frame 32, and an opening 534 is arranged on the mouth skirt 53 to allow the plurality of apertures 325 to be at least partially aligned with the opening 534. A purge valve 7 is sandwiched between the plurality of apertures 325 and the opening 534, so that the user can use his/her mouth to purge the water leaking in the body 3 and the exhaled dirty air to the outside from the orinasal pocket 56 through the skirt portion 53 and the mouth frame 32. And, because when the user's mouth M is accommodated in the mouth skirt 53, and the purge valve 7 is substantially corresponding to and closer to the user's mouth M, the blowing and exhaling efficiency is greatly improved. The comparison as to the relative spatial relationship between the mouth M of the present invention and the purge valve 7 (as shown in FIG. 5D) and the mouth M of the conventional FFSM and the purge valve 5 (as shown in FIG. 1B) can clearly show the mentioned result. More preferably, in this invention, the purge valve 7 includes a valve seat 71 and a valve plate 72 fixed at the center of the valve seat 71. The valve seat 71 is tightly coupled onto a periphery defining the opening 534 by threads or multi-flanges 711 at one side thereof, and is clipped onto the shield 321 of the mouth frame 32 at the other side thereof, so as to securely fix the purge valve 7 between the mouth skirt 53 and the mouth frame 32, as shown in FIG. 8, thereby achieving excellent stability and rigidity. Unlike the traditional FFSM, there is no longer need to extend the size of the lens portion downward to the bottom of the mask for the purge valve 5 to install (see FIGS. 1A and 1B) where the volume of the mask 1 cannot be reduced.

Based on the advantage that the purge valve 7 is not limited by the position, the size of the valve plate 72 is able to be enlarged. Preferably, its diameter can be set to range from 23 to 28 millimeters (mm), or even larger, thereby greatly increasing the efficiency of drainage and exhaust, and even being possible to take the purge valve 7 as the only passage for exhalation. That is to say, the exhaust passage 58 and the exhaust duct 42 of the breathing tube 4 can be eliminated. Furthermore, the direction of the drawing that FIG. 8 shows is very close to the state of the user wearing the mask 2 snorkeling in the water. At this time, the orinasal pocket 56 presents a shape like a funnel, wherein the drain tip of the funnel is where the purge valve 7 is located; that is to say, if there is unwilling water leaking in the mask, it will naturally accumulate in the setting of the purge valve 7 of the funnel-shaped orinasal pocket 56. The user only needs to exhale or blow through his/her mouth lightly in the water, and the water will be purged out, with no need to get out of the water or even take off the mask.

Figure 9A:
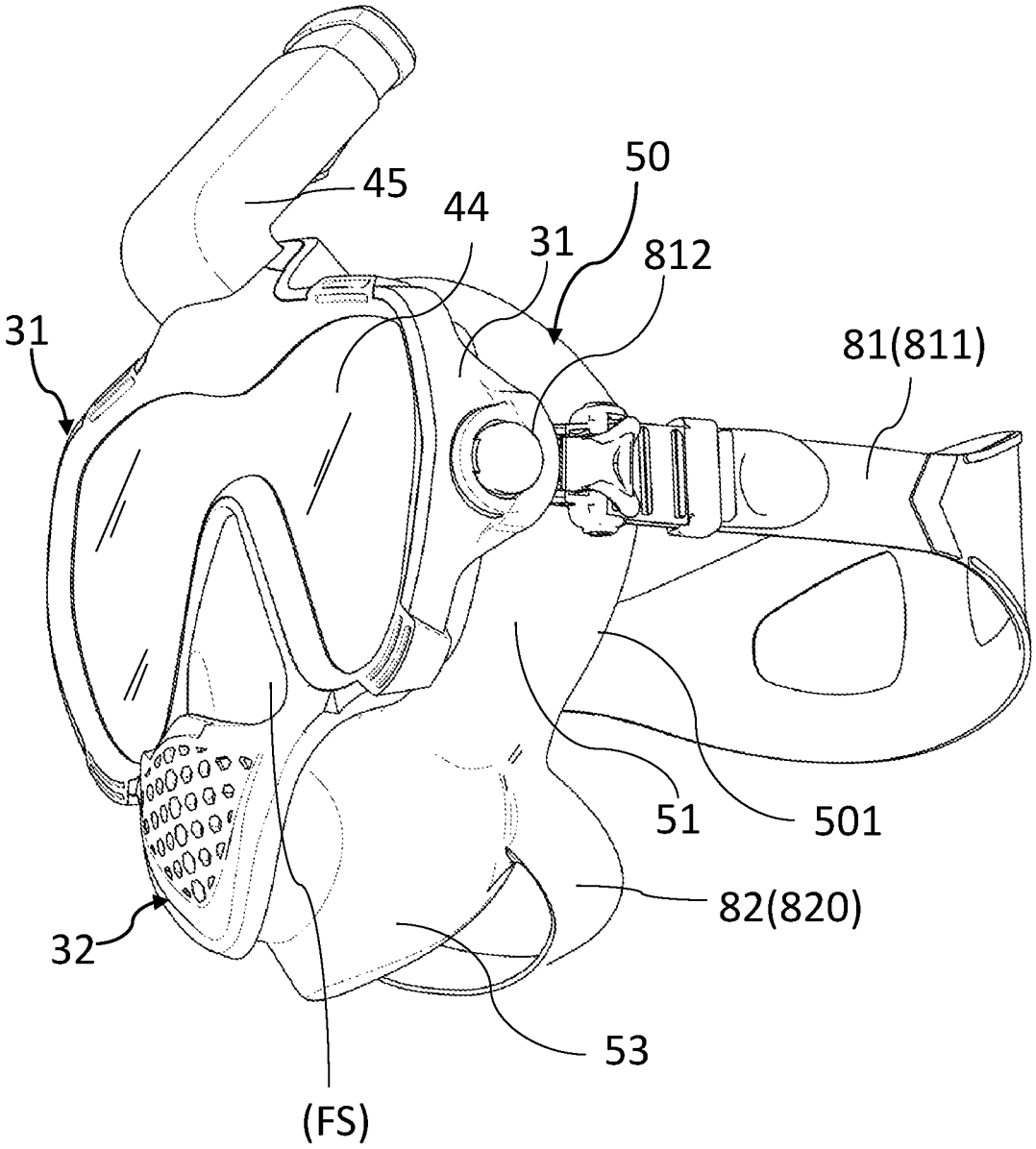
FIG. 9A is a schematic perspective view of yet another embodiment of the present invention, which has a fixed chin strap.

As compared to the existing FFSM, wearing the mask 2 of the present invention can be simpler, without oppression and losing the sense of waterproofness. Specifically, as shown in FIG. 9A, an upper fastening device 81 and a lower fastening device 82 are provided. Both extend from the rear of the body 3, so as to fasten the body 3 to the user's face with "three points" waterproof tightening. More specifically, the upper fastening device 81 has a head strap 811 and two fasteners 812 for respectively connecting two ends of the head strap 811. The two fasteners 812 are disposed on two opposite sides of the lens frame 31, respectively. The head strap 811 is at least one of elastic and adjustable, and each of the fasteners 812 can be in any measure to be connected to the two ends of the head strap 811. FIG. 9A (also in FIG. 11A) shows an adjustable head strap 811 which has two ends connecting with the fasteners 812 in a quick-release manner, but this is only an example, and does not limit the way of connection. The lower fastening device is preferably at least partially made of elastic material, extending backward from the rear edge 501 of the water sealing skirt 50, preferably the two sides of the rear edge of the mouth skirt 53, and being fixed with the user's chin or jawbone, in order to enhance the waterproofness between the mouth skirt 53 and the area near the mouth M of the user. More preferably, the lower fastening device is a chin strap or a chin pad, which will be described separately below.

Figure 9B:
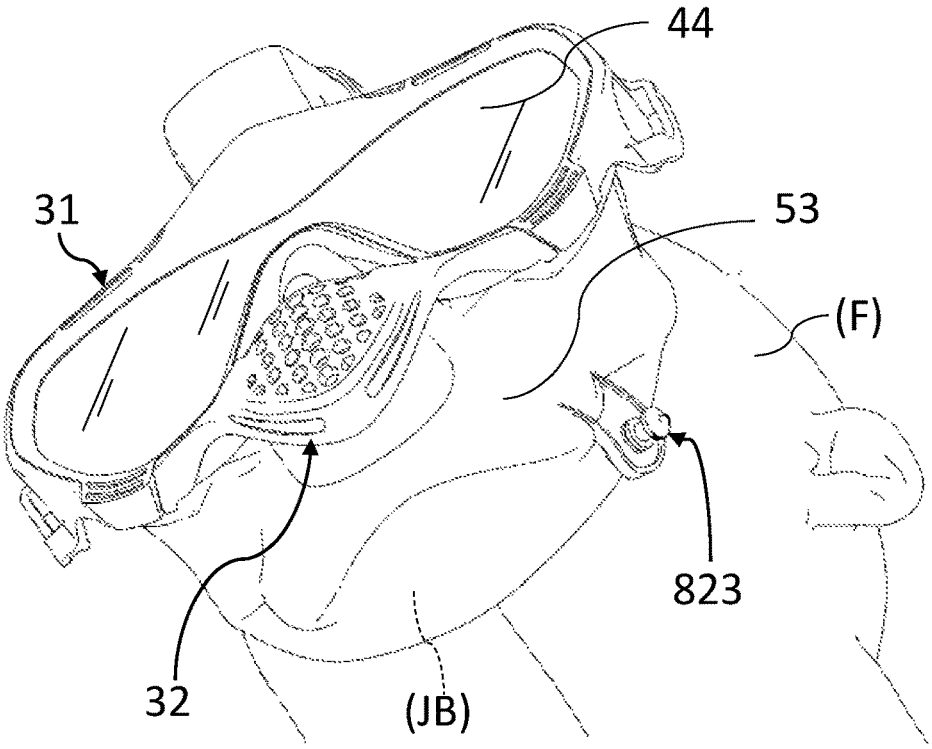
FIGS. 9B and 9C are schematic perspective views of yet a further embodiment of the present invention, which has an adjustable chin strap.
Figure 9C:
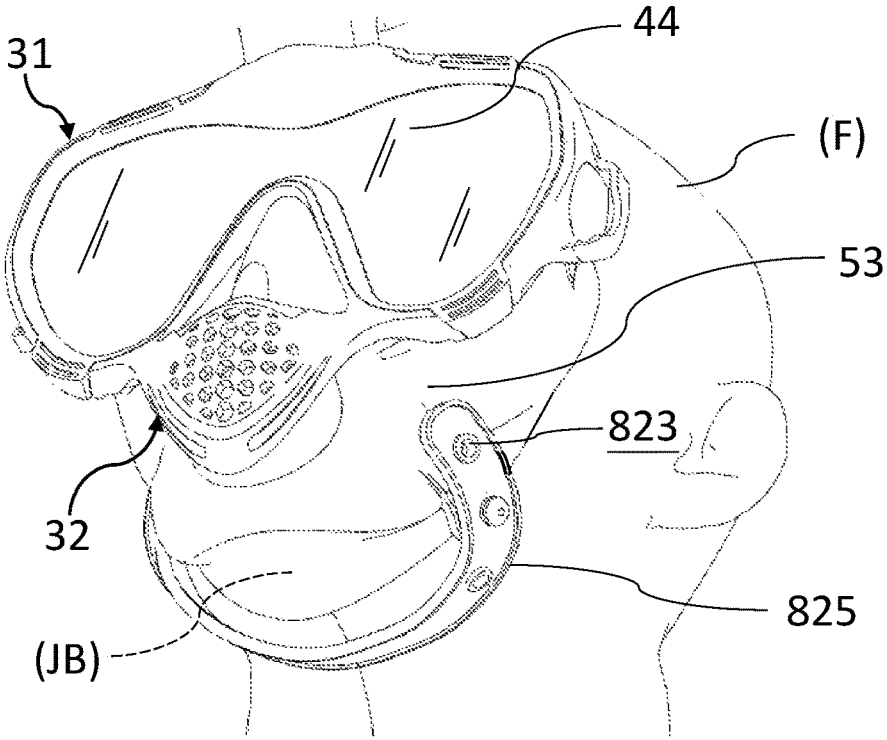

The embodiment as to the lower fastening device 82 being a chin strap is shown in FIGS. 5A-5D and 9A-9C. The chin strap 820 is connected between the two sides of the mouth skirt 53 (or two sides of both the eye skirt 51 and the mouth skirt 53). When the user wears the breathable mask 2, the chin strap 820 can be elastically tightened to the user on the area behind the user's chin or jawbone (JB). The two ends of the chin strap 820 can be formed at any position of the rear edge 501 of the water sealing skirt 50, such as integrally formed with the rear edges of the eye skirt 51 and the mouth skirt 53, or is detachably and/or adjustably connected to the mouth skirt 53, so that the length and tightness of the chin strap 820 can be fittingly adjusted. FIGS. 9B and 9C show one of the detachable and adjustable embodiments. Specifically, a male fastener 823 extends from both sides of the mouth skirt 53 for a plurality of female fasteners (i.e., holes 824) of the chin strap 825 to engage with, in order to set the chin strap 825 in proper tightness and achieve the purpose of adjustment.

Figure 10A:
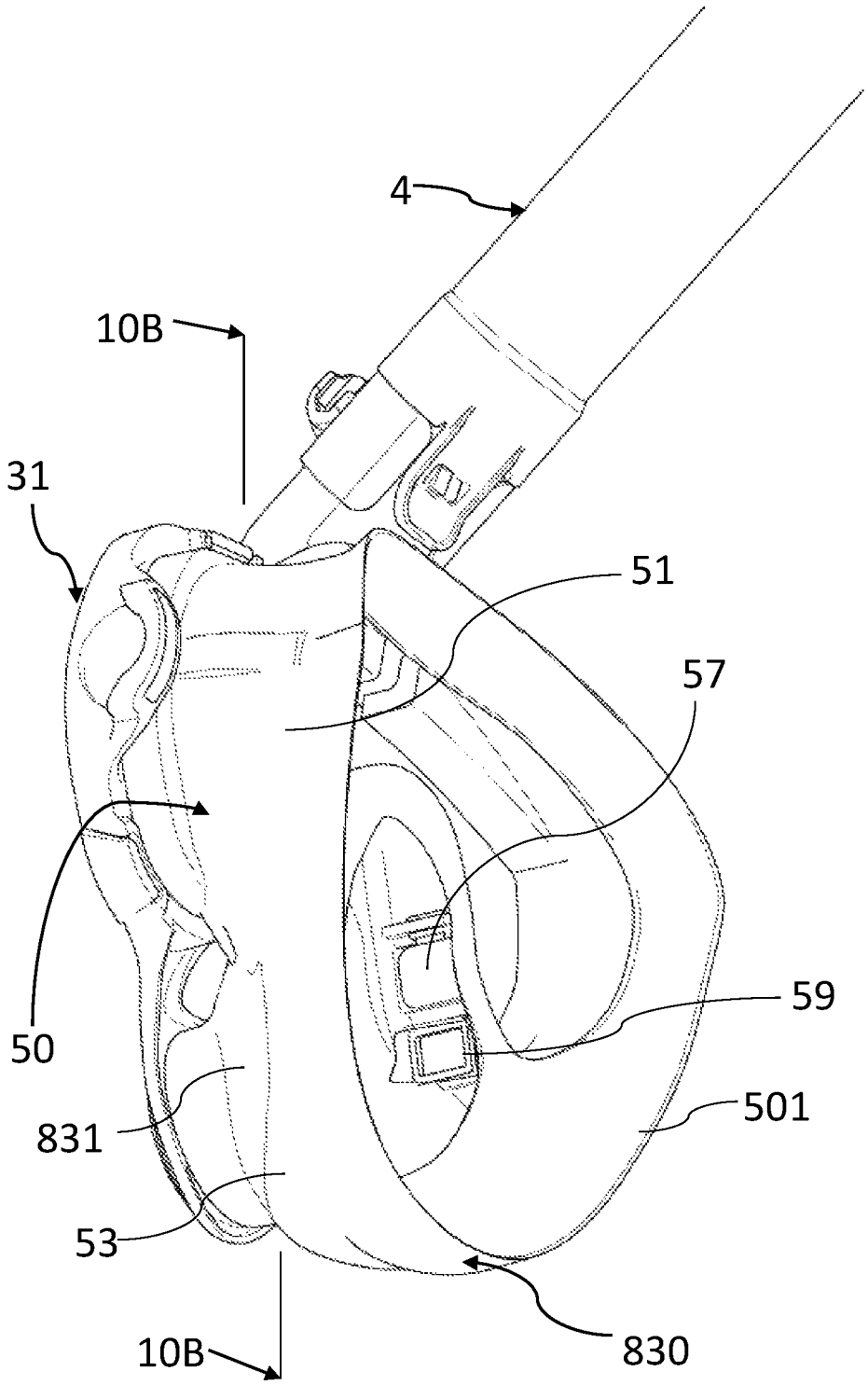
FIG. 10A is a three-dimensional schematic view of yet further another embodiment of the present invention, which has a chin pad.
Figure 11A:
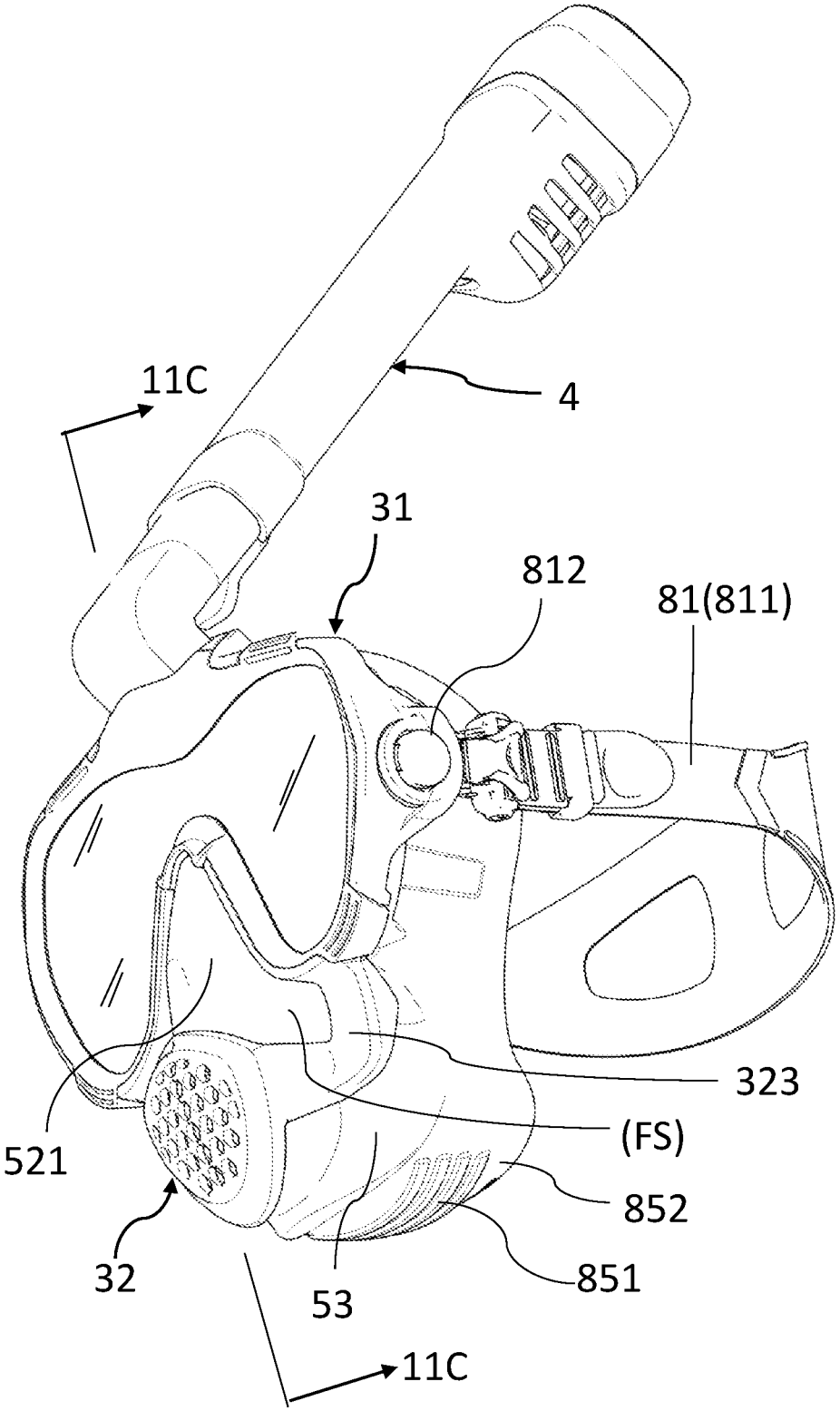
FIG. 11A is a schematic perspective view of yet another embodiment of the present invention, which has a chin pad.
Figure 11B:
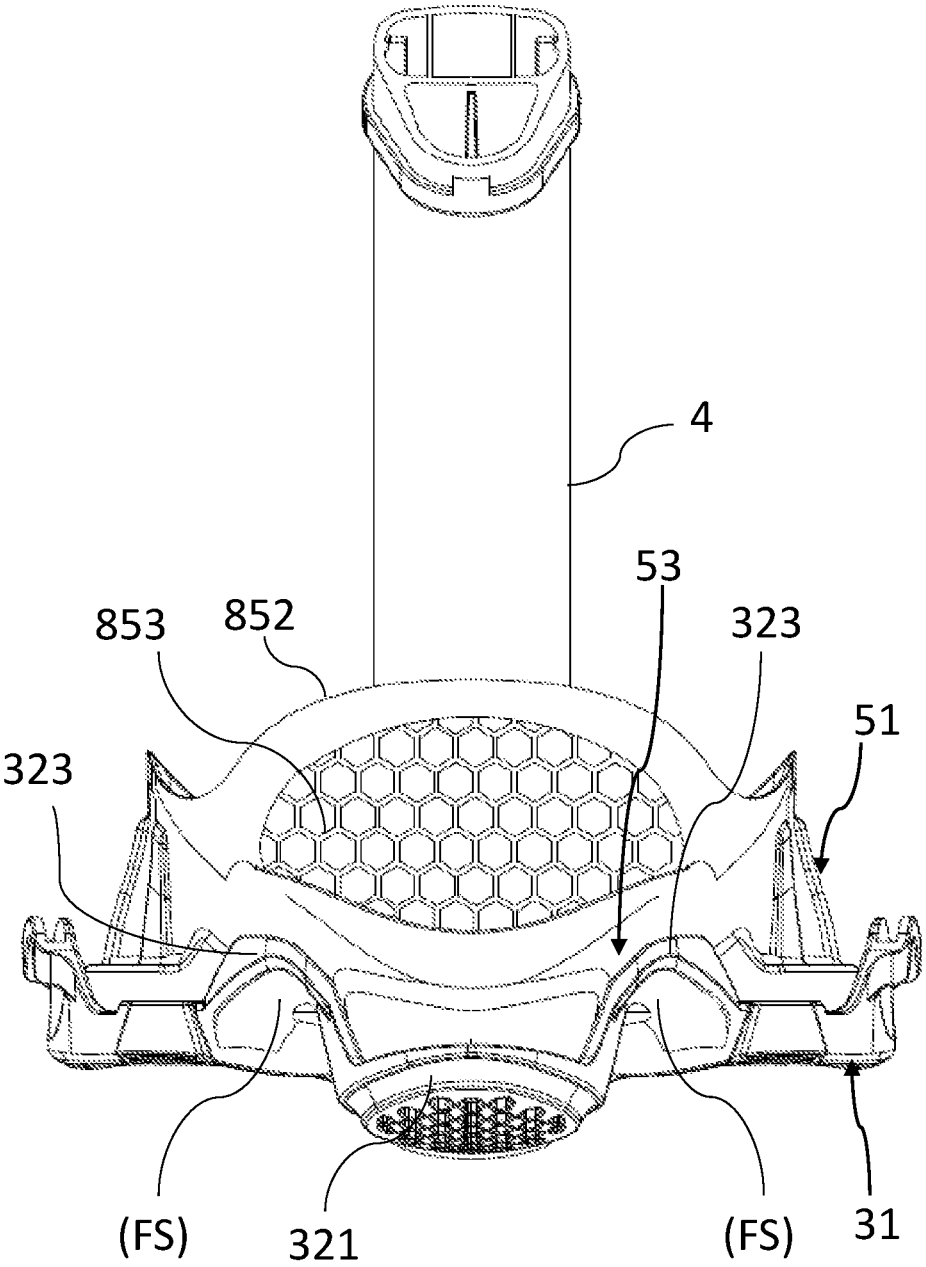
FIG. 11B is a schematic bottom view of yet another embodiment of the present invention, which has a chin pad in another form.
Figure 11C:
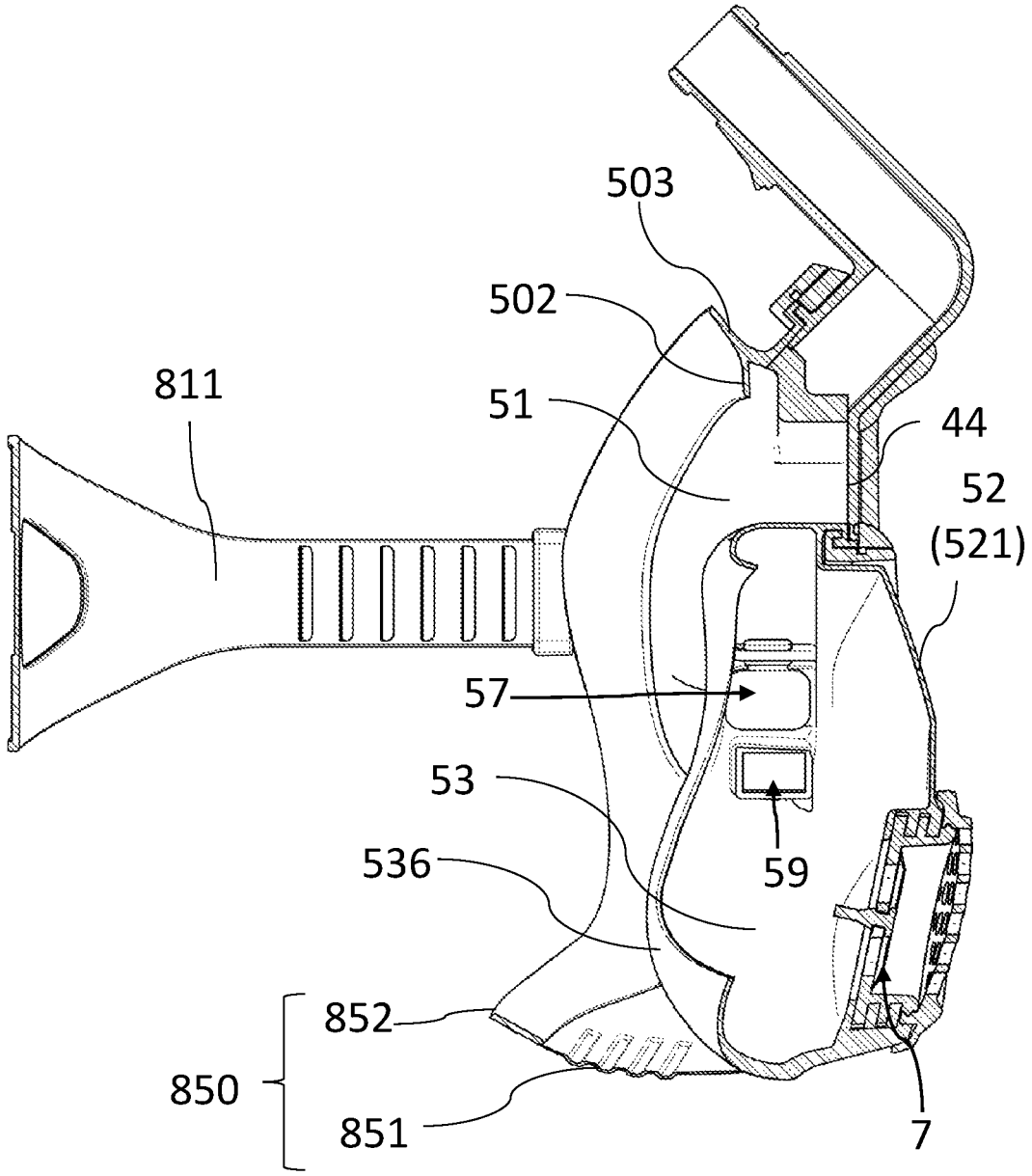
FIG. 11C is a schematic cross-sectional view, the sagittal plane of FIG. 11A.

The embodiment as to the lower fastening device 82 being a chin pad is shown in FIG. 10A. The chin pad 830 integrally extends from the lower end of the eye skirt 51 to the two rear edges of the mouth skirt 53, and further extends backward at the bottom of the mouth skirt 53. In another aspect of overall configuration, the chin pad 830 is integrally formed with the rear edge 501 of the water sealing skirt 50. This sort of chin pad 830 has a smaller size, wherein each of the two sides of the mouth skirt 53 is provided with a rib 831, which continuously extends downward from the eye skirt 51 and goes around the bottom of the mouth skirt 53 to increase the supportability of the chin pad 830, so that when the user wears the mask, the chin pad 830 elastically bears against the chin or jawbone (JB) of the user. Another sort of chin pad 850 has a larger size, as shown in FIG. 11A, which extends continuously and backward from the two rear edges of each of the eye skirt 51 and the mouth skirt 53 and is integrally formed with the mouth skirt 53. Specifically, the chin pad 850 includes a pad area 851 and an enclosing area 852 surrounding the pad area 851, wherein the enclosing area 852 and the mouth skirt 53 have the same material, and the pad area 851 has the different material or thickness from the enclosing area 852. In a greater detail, the material of the pad area 851 is selected from materials including TPR, TPU, silicone, PVC, rubber, or a combination thereof, and a material having a Shore Hardness of 10-80 is preferable. In terms of the thickness of the pad area 851, it is recommended that the thickness of the pad area 851 is smaller than the thickness of the surrounding area 852, and their thickness difference preferably ranges from 0.2 mm to 5 mm, so that when the user wears the mask, the pad area 851 of the chin pad 850 just bears against the user's chin or jawbone (JB), thereby increasing water resistance and comfort near the user's mouth. It is suggested that the surface of the pad area 851 can be made into a pleated or corrugated form as shown in FIG. 11A, or a honeycomb form (e.g., the pad area 853 in FIG. 11B) to increase the friction with the user's chin, avoid displacement during use, and enhance waterproof effects.

Figure 10B:
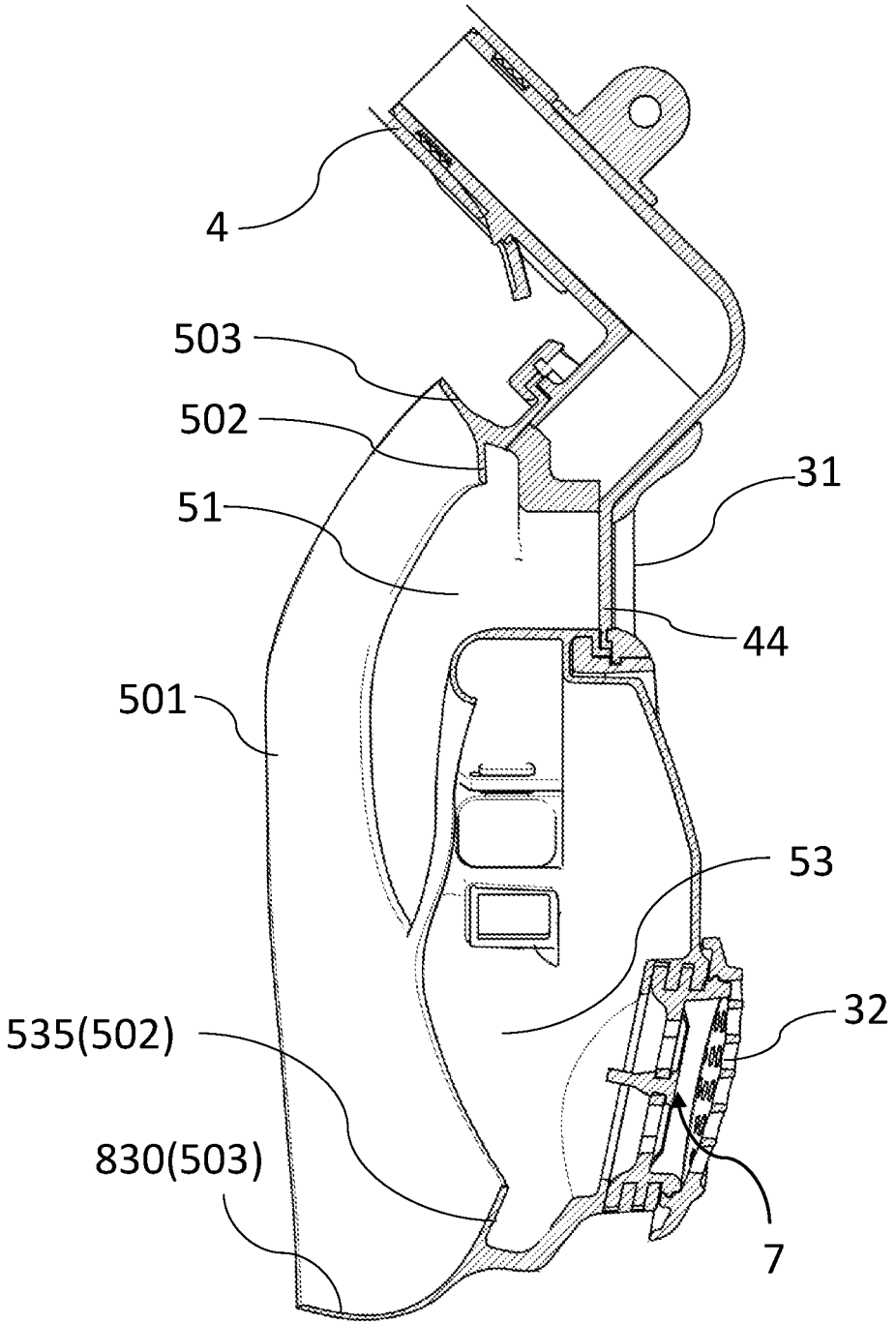
FIG. 10B is a schematic cross-sectional view, the sagittal plane of FIG. 10A.

It is worthwhile to mention that if the two sides of the chin pad 830 (also the clin pad 850) are connected upward to the rear edge of the eye skirt 51, then the entire rear edge 501 of the water sealing skirt 50 continues to have the Y-shaped cross section as shown in FIGS. 5D and 5E. In other words, the entire portion of the mask body 3 that is attached to the user's face (F) forms two layers of waterproof protection all the way along. That is, both of the inner first fitting portion 502 and the outer second fitting portion 503, are tightly attached to the user's face in a circle, wherein, at the lower area of the body 3, each of the water sealing edge 535 (i.e., flat edge, see FIG. 10B) and 536 (i.e., curved-folding edge, see FIG. 11C) of the mouth skirt 53 serves as the first fitting portion 502, and each of the chin pad 830 (FIG. 10B) and 850 (FIG. 11C) serves as the second fitting portion 503, thereby the waterproof effect and comfort is greatly improved.

Figure 12B:
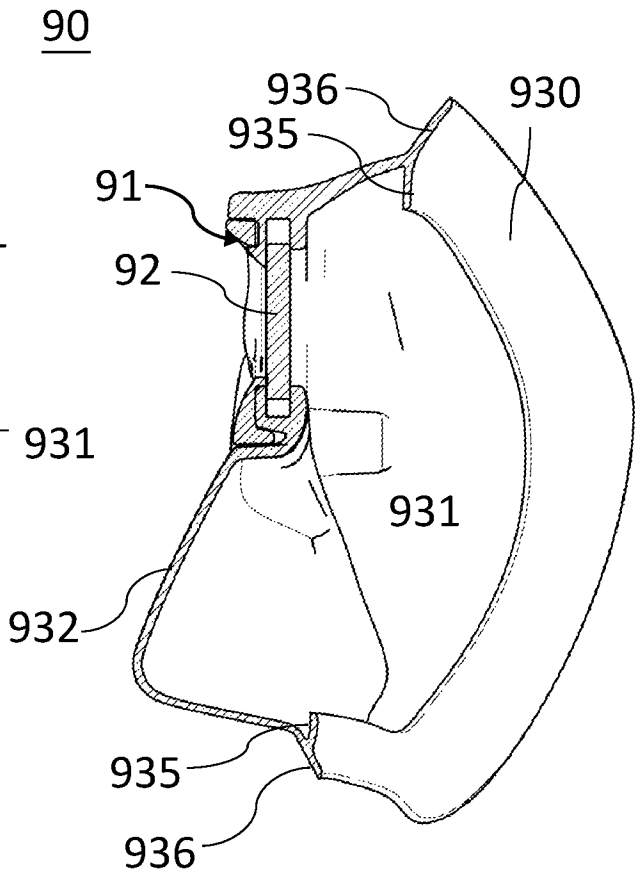
FIG. 12B is a schematic cross-sectional view, the sagittal plane taken along Line 12B-12B of FIG. 12A.
Figure 12A:
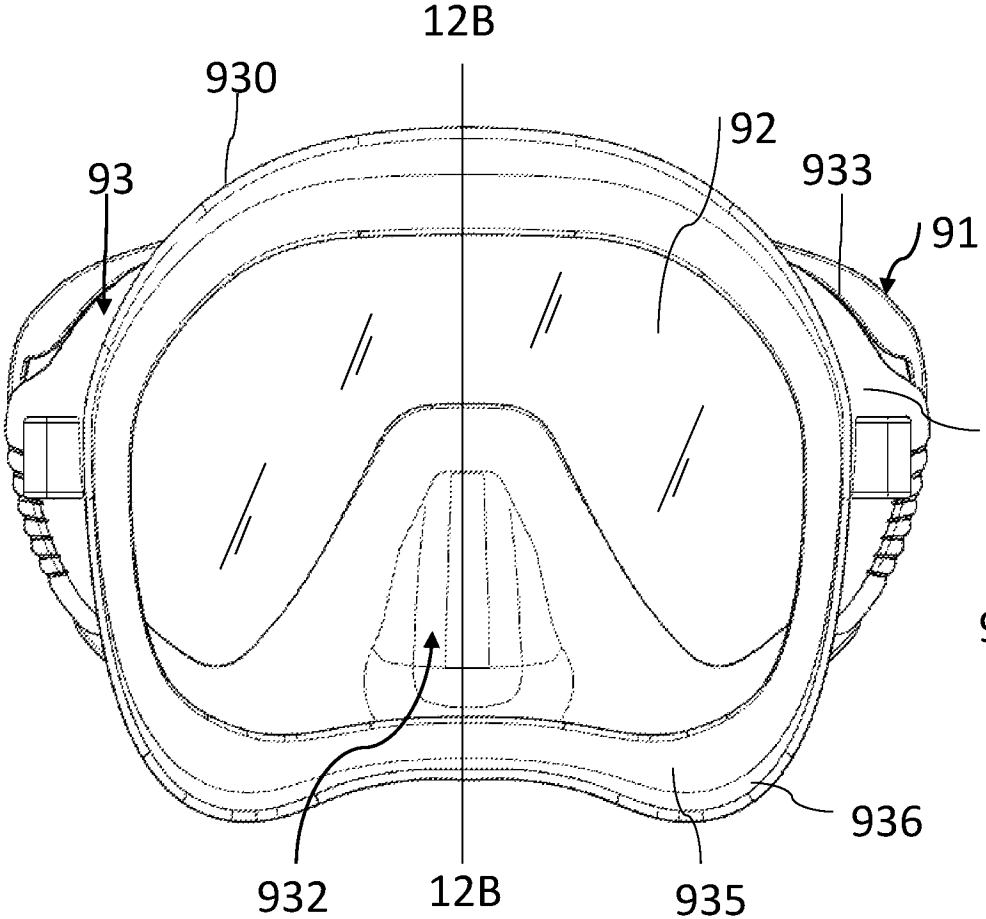
FIG. 12A is a schematic rear view of a diving mask covering the eyes and nose according to the present invention.

The mentioned double seal technology is also applicable to the existing diving mask covering the user's eyes and nose. In using this kind of diving mask, the area between the user's nostrils and the upper lip (that is, the so-called "philtrum") will often leak water, and the reason is because the facial lines in this area are complex, the water resistance is obviously insufficient in this area. Once the water enters the mask, it will naturally accumulate inside this area, and because this area is very close to the nostrils, it will cause the user to be extremely nervous. Now turning to FIGS. 12A and 12B showing how the double seal applies to the existing diving mask. Specifically, the diving mask 90 of this invention includes a lens frame 91, a transparent lens portion 92 and a water sealing skirt 93, in which the transparent lens portion 92 corresponds to the lens frame 91 in shape. The water sealing skirt 93 is integrally formed with an eye skirt 931 and a nose skirt 932, wherein the eye skirt 931 has a skirt frame 933 in the front thereof, and the skirt frame 933 corresponds to the transparent lens portion 92 in shape too. The transparent lens portion 92 and the skirt frame 933 are jointly waterproof and embedded in the lens frame 91, and the nose skirt 932 protrudes forward from a middle portion outside the lens frame 31. When the user puts on the diving mask 90, his/her eyes and nose are respectively accommodated in the eye skirt 931 and the nose skirt 932, and the rear edge of the water sealing skirt 93 is continuously formed with a double-seal ring 930. When wearing the diving mask 90, the user's eyes and nose are accommodated in the eye skirt 931 and the nose skirt 932, respectively, and the double-seal ring 930 is adapted to bear against a user's face along an outer periphery around the user's eyes and nose, i.e., the area between the user's nostrils and upper lip (not shown). Preferably, the double-seal ring 930 is formed with a first fitting portion 935 and a second fitting portion 936, which constitutes a Y-shaped cross-section as shown in FIG. 12B. When the rear periphery of the water sealing skirt 93 is in close contact with the user's face, the second fitting portion 936 is located at an outer periphery of the first fitting portion 935, whereby forming two-layer protection to further prevent water leakage.

In addition, unlike the existing FFSM in which the front of the entire mask body is almost formed with a rigid lens for all. In the present invention, between the lens frame 31 and the mouth frame 32, the nose frame 33 is also created, so that the soft nose skirt 52 can be protruded forward and outward from the nose frame 33 for the user to perform the Frenzel Equalization operation, which helps to balance the internal and external pressure of the mask, and can also improve the tightness of the mask onto and the user's face, especially when the mouth, nose and eyes are sealed within the mask, thereby keeping the pressure inside and outside the mask balanced, and also preventing water from entering. Specifically, the nose skirt 52 includes an equalizing portion 521 and a partition 522, which are separated by a section of the lens frame 31. The nose skirt 52 protrudes forward from the rear edge of the lens frame 31, and has a single-crest mountain shaped cross section, as shown in FIG. 5E. Preferably, the single-crest mountain shaped cross section defines an amplitude (Nh) ranging from 20 mm to 30 mm, measured from a valley to a top thereof; or the nose skirt 52 protrudes forward from the rear edge of the lens frame 31 for an extent (Nt) that exceeds an outer edge of the lens frame, in which the extent (Nt) ranges from 5 mm and 12 mm. The single-crest mountain shaped cross section has no ridge, the width between the valleys is greater than the height (i.e., the amplitude) thereof, and the two sides of the equalizing portion 521 are tightly embedded by the nose frame 33 which is defined by the lens frame 31. Even if it is subjected to high pressure several meters underwater, it will not collapse, be deformed, or become pinched. If the brackets are designed to be slightly bent backward, such as the brackets 323 shown in FIGS. 11A and 11B, a larger finger entry space (FS) can be formed to provide users to do faster and more convenient equalization operation. Of course, if the equalization operation is not considered or required, it is also feasible to make portion or all the nose skirt 52 with rigid materials.

In addition to the above-mentioned preferred embodiments that have described in details the structure and operation mode of the technology of the present invention, any other embodiments transformed based on the concept of the present invention shall belong to the equivalents of the present invention, and shall not limit the scope of the literal meanings as set forth in the last paragraph.

What is claimed is:

1. A breathable mask, comprising a body and a breathing tube, the body having an interior capable of being in fluid communication with the breathing tube; the body including:

a main frame, having a lens frame and a mouth frame which extends downward from the lens frame, and defines a nose frame together with the lens frame; the mouth frame being in fluid communication with an outside;

a lens module having a transparent lens portion corresponding to a shape of the lens frame;

a water sealing skirt, formed with an eye skirt, a nose skirt, and a mouth skirt; wherein the eye skirt has a skirt frame formed on a front thereof and corresponding to a shape of the transparent lens portion;

wherein the transparent lens portion and the skirt frame are jointly waterproof and embedded in the lens frame, and the nose skirt protrudes outward from the nose frame; and wherein the mouth skirt is in fluid communication with the outside through the mouth frame, and the transparent lens portion does not protrude outward from an outer edge of the lens frame;

whereby when wearing the breathable mask, a user's eyes, nose and mouth are respectively accommodated in the eye skirt, the nose skirt and the mouth skirt, and a rear edge of the water sealing skirt continuously and closely fits a user's face along an outer periphery of the user's eyes, the nose, and the mouth;

wherein the nose skirt includes an equalizing portion and a partition, which are separated by a section of the lens frame; and wherein the eye skirt, the transparent lens portion and the partition define an eye pocket for accommodating the user's eyes, and the equalizing portion, the partition and the mouth skirt define an orinasal pocket for accommodating the user's nose and mouth.

2. The breathable mask as claimed in claim 1, further comprising a sub-frame, wherein the lens frame has a rigid inner flange, and the skirt frame has a soft flange corresponding in shape to and overlapping the rigid inner flange, the transparent lens portion has an outer periphery overlapping the soft flange, and the sub-frame overlaps the outer periphery of the lens portion and fastened onto to the lens frame, thereby the transparent lens portion and the skirt frame is jointly waterproof and inlaid in the lens frame.

3. The breathable mask as claimed in claim 2, wherein the sub-frame and the lens frame are fastened to each other by clips or adhesives.

4. The breathable mask as claimed in claim 1, wherein the mouth frame has a shield and two brackets, respectively extending from two lower sides of the lens frame portion and connecting the shield.

5. The breathable mask as claimed in claim 1, wherein the partition is provided with at least one pivot check valve to provide a unidirectional air flow from the eye pocket to the orinasal pocket.

6. The breathable mask as claimed in claim 5, wherein the partition is symmetrically provided with two pivot check valves, each pivot check valve is rectangular, and one of its width and height is between 5 mm and 30 mm.

7. The breathable mask as claimed in claim 5, wherein the partition is symmetrically provided with two pivot check valves, and each of the check valves is shaped rectangular and has a thickness ranging from 0.3 mm to 3 mm.

8. The breathable mask as claimed in claim 5, wherein the partition is symmetrically provided with two pivot check valves, and each of the check valves has a rectangular swing lid, a fixing portion and a pivot axle disposed between the swing lid and the fixing portion.

9. The breathable mask as claimed in claim 8, wherein each of the pivot axles is formed by thinning one side of each of the swing lids.

10. The breathable mask as claimed in claim 1, further comprising an exhaust passage which runs along an inner peripheral edge of the lens frame and which is defined by the eye skirt and an outer peripheral surface of the transparent lens portion, wherein the exhaust passage is in fluid communication with the breathing tube at an upper end thereof, and with the orinasal pocket at a lower end thereof.

11. The breathable mask as claimed in claim 1, wherein the water sealing skirt has a rear edge entirely having a Y-shaped cross-section, continuously forming a first fitting portion and a second fitting portion along the rear edge, whereby when the rear edge of the water sealing skirt is in close contact with the user's face, the second fitting portion is located at an outer periphery of the first fitting portion.

12. The breathable mask as claimed in claim 1, wherein the transparent lens portion is a full planar lens.

13. The breathable mask as claimed in claim 1, wherein the lens frame is an angular-bending lens frame, the transparent lens portion is an angular-bending lens which comprises a flat portion and two bending portions, respectively extending backward from two opposing sides of the flat portion, and the skirt frame is an angular-bending skirt frame, and wherein the angular-bending lens frame, the angular-bending lens and the angular-bending skirt frame have corresponding shapes to facilitate mutual fitting of one another.

* * * * *